US006845825B2

(12) United States Patent
Bischel et al.

(10) Patent No.: US 6,845,825 B2
(45) Date of Patent: Jan. 25, 2005

(54) METHOD AND APPARATUS FOR ATTACHING/DETACHING DRILL ROD

(75) Inventors: Brian J. Bischel, Hartland, WI (US); Mark Van Howelingen, Knoxville, IA (US); Mark R. Stelter, Pella, IA (US); Trail Price, Jackson, MN (US); Peter C. Rozendaal, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 10/055,458

(22) Filed: Jan. 22, 2002

(65) Prior Publication Data

US 2002/0157870 A1 Oct. 31, 2002

Related U.S. Application Data

(60) Provisional application No. 60/263,342, filed on Jan. 22, 2001.

(51) Int. Cl.[7] ..... E21B 3/02; E21B 7/04

(52) U.S. Cl. ..... 175/24; 175/51; 175/52; 175/85; 175/113; 175/220; 175/4; 175/176

(58) Field of Search ..... 175/24, 51, 52, 175/85, 113, 162, 220; 414/22.51, 22.71, 22.65, 22.67–22.69; 173/152, 321, 4, 52, 176

(56) References Cited

U.S. PATENT DOCUMENTS

| | | | | | |
|---|---|---|---|---|---|
| 4,604,724 | A | * | 8/1986 | Shaginian et al. | 175/52 |
| 5,988,299 | A | * | 11/1999 | Hansen et al. | 175/52 |
| 6,079,506 | A | | 6/2000 | Mercer | |
| 6,179,065 | B1 | | 1/2001 | Payne et al. | |
| 6,357,537 | B1 | * | 3/2002 | Runquist et al. | 175/62 |
| 6,374,928 | B1 | * | 4/2002 | Teller et al. | 175/52 |
| 6,408,954 | B1 | * | 6/2002 | Price et al. | 175/52 |
| 6,435,286 | B1 | | 8/2002 | Stump et al. | |
| RE37,923 | E | | 12/2002 | Keating et al. | |
| 6,491,115 | B2 | | 12/2002 | Van Houwelingen et al. | |
| 6,550,547 | B1 | | 4/2003 | Payne et al. | |
| 6,588,981 | B2 | * | 7/2003 | Willis et al. | 414/22.51 |
| 6,615,931 | B2 | * | 9/2003 | Dycus et al. | 175/162 |
| 6,634,443 | B1 | * | 10/2003 | Paech et al. | 175/85 |
| 2001/0052426 | A1 | | 12/2001 | Mercer | |

FOREIGN PATENT DOCUMENTS

| | | |
|---|---|---|
| EP | 0 984 132 A2 | 3/2000 |
| WO | WO 01/51760 A2 | 7/2001 |
| WO | WO 02/06630 A1 | 1/2002 |
| WO | WO 02/06633 A1 | 1/2002 |

* cited by examiner

*Primary Examiner*—David Bagnell
*Assistant Examiner*—Matthew J Smith
(74) *Attorney, Agent, or Firm*—Merchant & Gould P.C.

(57) ABSTRACT

A control system for a drilling machine is disclosed. The drilling machine includes a rod driver for driving a string of rods into the ground, and for removing the string of rods from the ground. The drilling machine also includes a magazine for storing rods near the rod driver. A rod transfer mechanism moves rods between the magazine and the rod driver. Vices are used to make and break joints between the rods of the drill string. The control system includes joysticks equipped with switches for controlling operational sequences of the vices and the rod transfer mechanism.

11 Claims, 19 Drawing Sheets

METHOD AND APPARATUS FOR ATTACHING/DETACHING DRILL ROD

CROSS-REFERENCE TO RELATED APPLICATIONS

This application claims priority to provisional application U.S. Ser. No. 60/263,342, filed Jan. 22, 2001.

FIELD OF THE INVENTION

The present invention relates generally to underground drilling machines. More particularly, the present invention relates to systems for attaching and detaching rods to and from a drill string during the drilling process.

BACKGROUND OF THE INVENTION

Drilling machines have been used for boring holes in the ground for many years and are used in a wide variety of applications, including boring horizontally for installing underground utilities. The basic components of a typical horizontal drilling machine include a rotational drive assembly, a longitudinal driver, a rod transferring apparatus, and a vice assembly. Each of these basic components has typically been independently controlled by dedicated controls located at an operator's station.

A conventional drilling process involves rotating a drill string (i.e., a string of interconnected pipes or rods) with the rotational drive assembly while simultaneously propelling it longitudinally. The rotational drive assembly is typically threaded into the top of the drill string, and is thus capable of rotating the entire drill string. A drilling bit is typically mounted on the opposite, bottom end of the drill string. The thrust for propelling the drill string longitudinally is provided by the longitudinal driver which typically includes an elongated guide or track on which the rotational drive assembly is slidably mounted. This longitudinal drive mechanism is capable of longitudinally propelling the drill string to advance the drill string and extend the length of the bored hole. The process of drilling a hole, longer than the length of one rod, involves the following basic steps:

1) transferring a rod from storage to a position in alignment with the rotational drive assembly;
2) attaching the top end of the rod to the rotational drive assembly and the bottom end of the rod to the drill string or drill bit, thus making the rod a part of the drill string;
3) rotating the drill string with the rotational drive assembly while advancing the rotational drive assembly forwardly along the track to propel the drill string into the ground until the rotational drive assembly is at the end of the track;
4) holding the drill string with the vice assembly while the rotational drive assembly is reversed to detach from the drill string;
5) propelling the rotational drive assembly rearwardly along the track in preparation for inserting another rod; and
6) repeating the above process thereby extending the length of the drill string and the bored hole.

As indicated above, a common purpose for drilling a bore along a predetermined path is for the installation of utilities such as cable or pipe. After the bore has been drilled, the utilities are installed within the bore by attaching the desired utility to the bottom end of the drill string and pulling the utility back through the bore. Frequently, a back reaming process is used to enlarge the bore as the utility is pulled back through the bore. During the pullback process, the above steps are basically reversed to remove rods from the drill string and to insert the removed rods back in to storage.

SUMMARY

The present disclosure relates to a drilling machine control system having a variety of inventive features for enhancing the ease of operation of the drilling machine.

A variety of other aspects of the invention are set forth in part in the description that follows, and in part will be apparent from the description, or may be learned by practicing the invention. The aspects of the invention relate to individual features as well as combinations of features. It is to be understood that both the foregoing general description and the following detailed description are exemplary and explanatory only and are not restrictive of the invention as claimed.

Figure 1A:
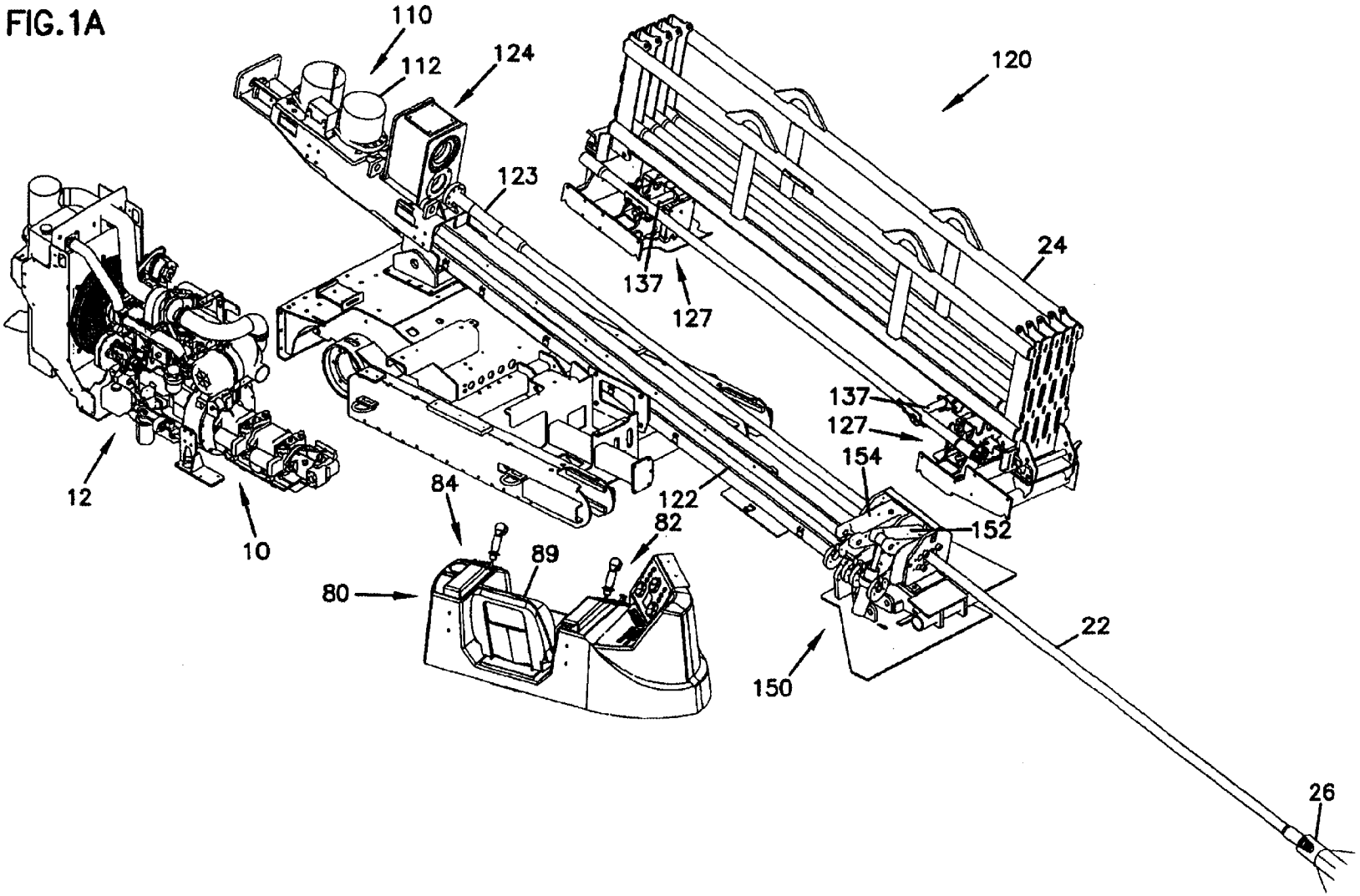
FIG. 1A is a partially exploded view of a representative horizontal-drilling machine.

While the invention is amenable to various modifications and alternative forms, specifics thereof have been shown by way of example in the drawings and will be described in detail hereinbelow. It is to be understood, however, that the intention is not to limit the invention to the particular embodiments described. On the contrary, the invention is intended to cover all modifications, equivalents, and alternatives falling within the scope of the invention as defined by the appended claims.

DETAILED DESCRIPTION

In the following detailed description, references are made to the accompanying drawings that depict various embodiments in which the invention may be practiced. It is to be understood that other embodiments may be utilized, and structural and functional changes may be made without departing from the scope of the present invention.

I. Representative Drilling Machine

Figure 1B:
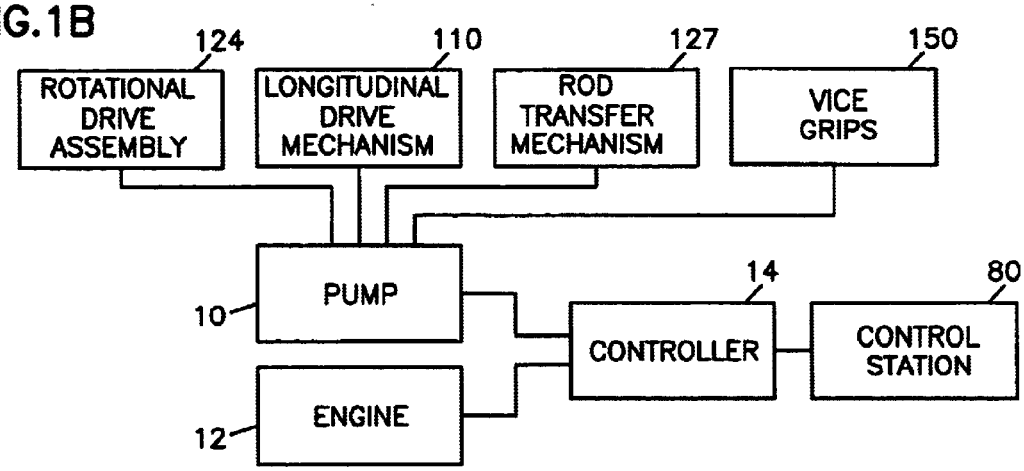
FIG. 1B is a block diagram showing various components of the machine of FIG. 1A.

The basic components of a representative horizontal directional drilling machine 120 are illustrated in FIG. 1. The directional drilling machine 120 includes an elongated guide or track 122 that can be positioned by an operator at any number of different oblique angles relative to is the ground. A rotational drive assembly 124 (i.e., a drive head) is mounted on the track 122. The rotational drive assembly 124 is adapted for rotating a drill string 22 (i.e., a string of interconnected rods) in clockwise and counterclockwise directions about a longitudinal axis of the drill string 22. A drill bit 26 is mounted at the bottom end of the drill string 22. The rotational drive assembly 124 includes a drive chuck 123 for connecting the rotational drive assembly 124 to the top end of the drill string 22. Gripping units 150 (e.g., lower and upper vice grips 152, 154 or wrenches) are provided adjacent the track 122 for use in coupling and uncoupling rods to the drive chuck 123 and/or the drill string 22. Examples of known vices can be found in U.S. Pat. Nos. 5,75 8,553 and 5,740,703, which are hereby incorporated by reference. In a preferred embodiment, the upper vice 154 can be rotated (e.g., by a drive cylinder) relative to the lower vice 152 to tighten or break joints between drill rods. A thrust mechanism or longitudinal drive mechanism 110 is provided for: 1) pushing the rotational drive assembly 124 down the track 122 to push a drill string 22 into the ground during drilling operations; and 2) pulling the rotational drive assembly 124 up the track 122 to pull a drill string 22 from the ground during reaming/pull-back operations.

Referring still to FIG. 1, the longitudinal drive mechanism 110 includes a longitudinal driver 112, preferably a hydraulic motor or a hydraulic cylinder. Likewise the rotational drive assembly 124 includes rotational driver (not shown) preferably a hydraulic motor. Rotational driver and longitudinal driver 112 are powered by a drive member, typically a hydraulic pump 10. Hydraulic pumps are typically utilized as hydraulic systems to provide an efficient method to transfer power. While hydraulic drives are preferred, it will be appreciated that any number of different types of drive mechanisms (e.g., electric motors and electricity) could also be used to provide the longitudinal drive and rotational drive functions.

An engine 12 powers the hydraulic pump 10. Here again other options such as fuel cells may be available, capable of producing electricity where the power could be transferred through wires. The preferred embodiment includes the use of an engine 12 to power the pump 10 which produces fluid power that is transferred through hydraulic lines to the drivers. Drivers corresponding to other components (e.g., the gripping units 150) can also be powered by the pump 10 and engine 12.

The drilling machine 120 further includes a rod box 24 (e.g., a magazine or other type of container) for storing rods adjacent to the track 122. A rod transfer mechanism 127 functions to move rods between the rod box 24 and the track 122. As shown in FIG. 1, the rod transfer mechanism 127 include transfer arms 137 for moving rods to and from the rod box 24. Movement of the transfer arms 137 can be provided by any number of known drive configurations. In one embodiment, hydraulic cylinders driven by the pump 10 function to drive the transfer arms 137. Additional information relating to rod transfer mechanisms is disclosed in U.S. application Ser. Nos. 09/602,322 and 09/602,843, as well as U.S. Pat. Nos. 5,607,280 and 5,556,253, all of which are hereby incorporated by reference.

All of the main components of the drilling machine 120 (e.g., the rotational drive assembly 124, the longitudinal drive mechanism 110, the rod transfer mechanism 127 and the gripping units 150) are preferably capable of being controlled from a single location such as an operator's station 80. The operator's station 80 includes left hand controls 84 and right hand controls 82. These controls serve as inputs to a controller 14 (shown in FIG. 1B). Additional inputs to controller 14 can include position sensors that indicate the status of a certain mechanism of the drilling machine. Controller 14 includes outputs that control pump 10, where it is recognized that there may be several pumps, possibly a separate pump for each basic function. Other outputs include solenoid drivers that are capable of controlling the flow and or pressure of the hydraulic fluid that is being supplied by pump 10. It will be appreciated that the above-described components are well known in the art and can have any number of different configurations.

II. Exemplary Operator Control Configurations

Figure 2:
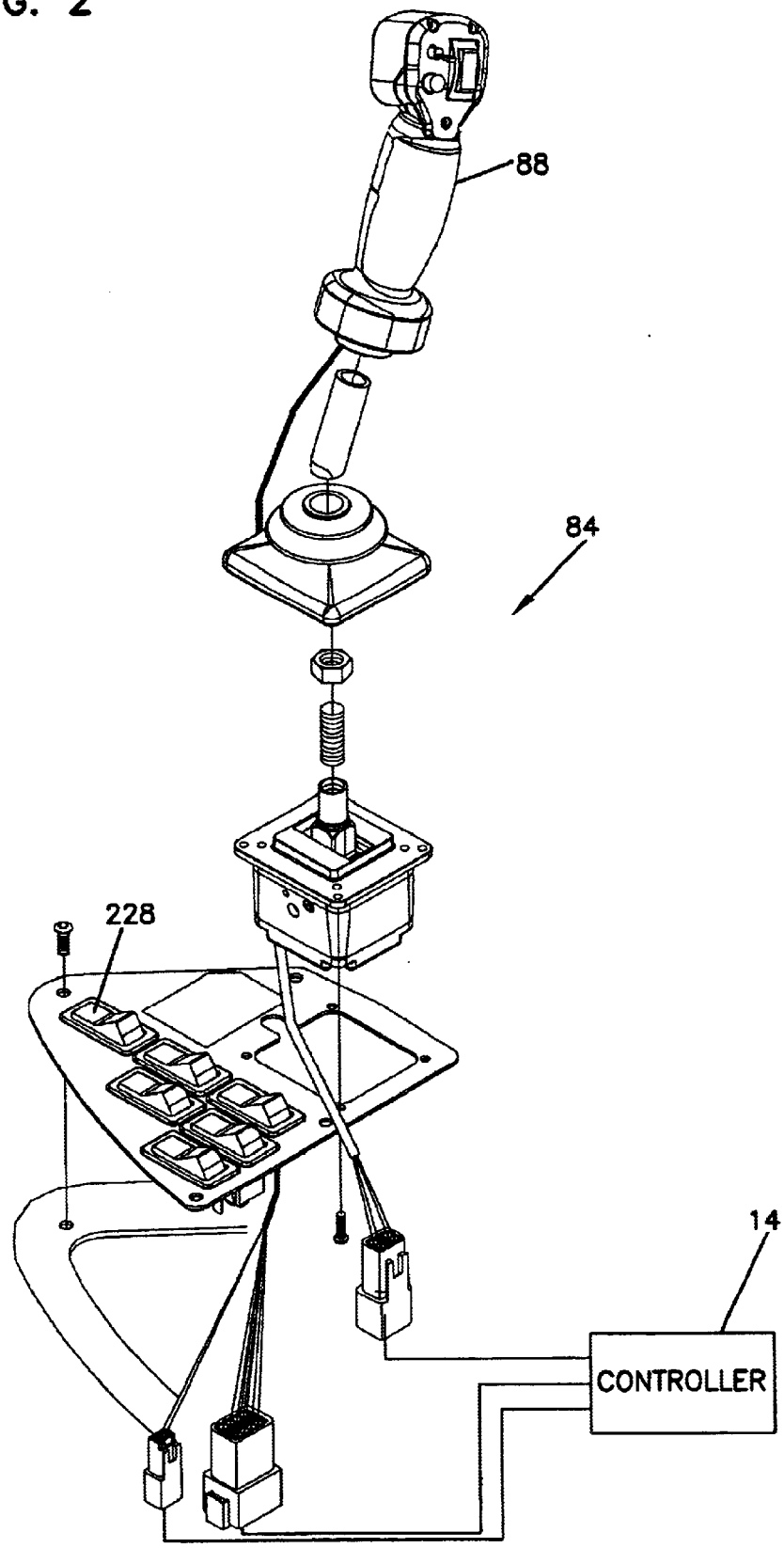
FIG. 2 is an exploded view of the left hand operator controls of a first embodiment of the present invention.

It will be appreciated that a variety of different operator control configurations can be used to practice the various aspect of the present invention. FIGS. 2–5 illustrate a first embodiment of an operator's control. FIG. 2 illustrates the left-hand controls 84 which include a left joystick 88 that is pivoted to control the rotational drive assembly 124, and a panel of other switches including sequence switch 228. The sequence switch 228 is a 2-position switch allowing selection between drilling or pullback/back ream. The other switches on the panel preferably allow each movement of the rod transfer mechanism 127 to be individually manually controlled if desired.

Figure 3:
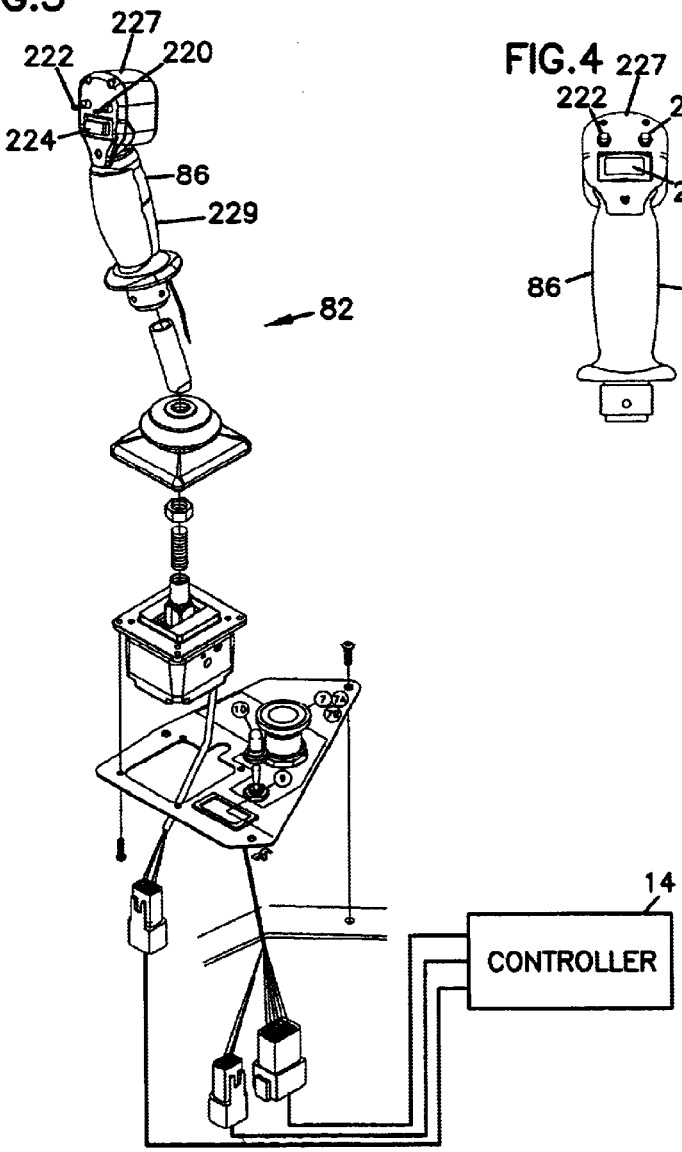
FIG. 3 is an exploded view of the right hand operator controls of a first embodiment of the present invention.
Figure 4:
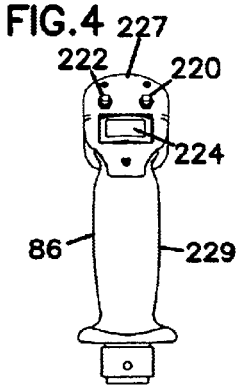
FIG. 4 is a front view of the right hand operator joystick of a first embodiment of the present invention.
Figure 5:
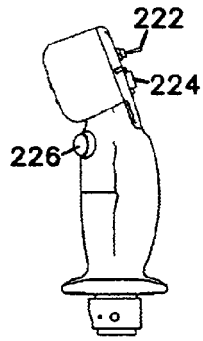
FIG. 5 is a side view of the right hand operator joystick of a first embodiment of the present invention.

FIGS. 3–5 illustrate the right hand controls 82 that include a right joystick 86 that is pivoted to control the longitudinal drive mechanism 110 and various switches. For example, in one embodiment, 4 switches can be mounted on the right joystick 86. The switches can include:

1) a first switch 220 that controls actuation of the lower vice grip 152;
2) a second switch 222 that controls actuation of the upper vice grip 154;
3) a third switch 224 that controls rotation of the upper vice 154; and
4) a fourth start button 226 for initiating completion of a rod loader sequence.

The first switch 220 is preferably a 2-position switch including a first position for clamping the vice 152 and a second position for releasing the vice 152. The second switch 222 is preferably a 2-position switch including a first position for clamping the vice 154 and a second position for releasing the vice 154. The third switch 224 is preferably a 3-position momentary rocker switch. The switch 224 is biased toward a neutral position. When rocked to a tighten-vice position, the vice 154 is rotated so as to tighten a joint between rods. When rocked to a break-joint position, the vice 154 is rotated so as to tighten a joint between rods. The start button 226 is preferably a momentary switch that is biased toward a non-actuating position. When depressed, the start button 226 causes initiation of the rod loader sequence.

The switches 220, 222 and 224 are positioned on an enlarged head 227 of the joystick 86 and preferably face toward an operator seated in chair 89 (see FIG. 1). The switch 226 is positioned on a lower grip portion 229 of the joystick 86 and preferably faces away from an operator seated in chair 89. Switch 226 is preferably actuated with a users index finger while switches 220, 222 and 224 are actuated with a users thumb.

Figure 6:
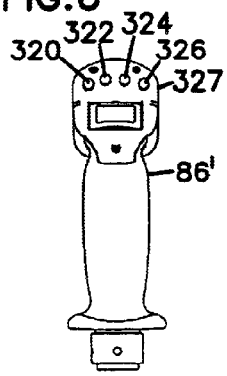
FIG. 6 is a front view of a second embodiment of a left hand operator joystick.

A second embodiment of a right joystick 86' is shown in FIG. 6. Joystick 86' includes an enlarged head 327 having 4 switches adapted to face toward an operator seated in chair 89. The switches include:

1) button 320 which is a 2 position switch (momentary push—release neutral) with the function changing depending on cycle;
2) button 322 which is a 2 position switch (momentary push—release neutral) with the function changing depending on cycle;
3) button 324 which is a 2 position switch (momentary push—release neutral) with the function changing depending on cycle; and
4) button 326 which is a 2 position switch (momentary push—release neutral) with the function changing depending on cycle.

The function of these switches will be described in more detail later. They are utilized to control the functions required to add or remove rods 20.

III. Rod Transfer Mechanism

FIGS. 7A–7G illustrate the components of the rod transfer mechanism 127 in various positions relative to the drill string 22 and the rod box 24. The rod transfer mechanism 127 includes a pair of selector combs 144 (only one shown in FIGS. 7A–7G) and a pair of pipe lifts 145 (only one shown in FIGS. 7A–7G). The pipe lifts 145 are located beneath the rod box 24 and are preferably raised and lowered by a drive member such as a hydraulic cylinder. The combs 144 are also positioned beneath the rod box 24. Preferably a drive member such as a hydraulic cylinder is used to move the combs 144 laterally relative to the rod box. The rod transfer arms 137 are preferably mounted on the pipe lifts 145 so as to be raised and lowered by the pipe lifts 145.

Figure 7A:
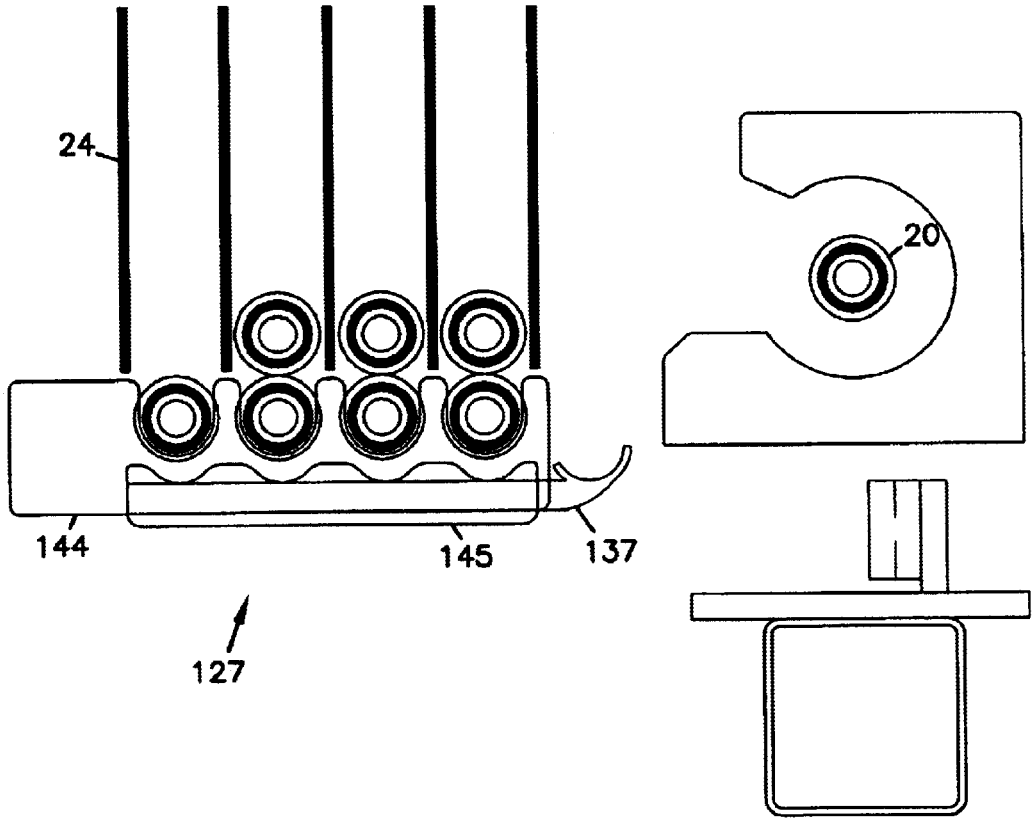
FIGS. 7A–7G are side views showing various positions of the components of a representative rod transferring apparatus.
Figure 7B:
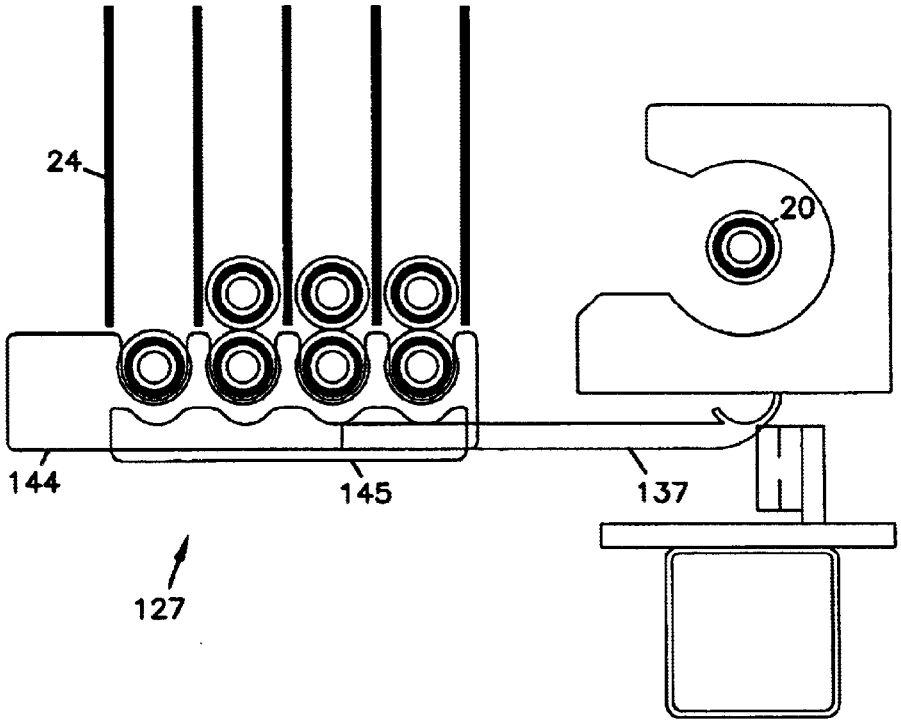
Figure 7C:
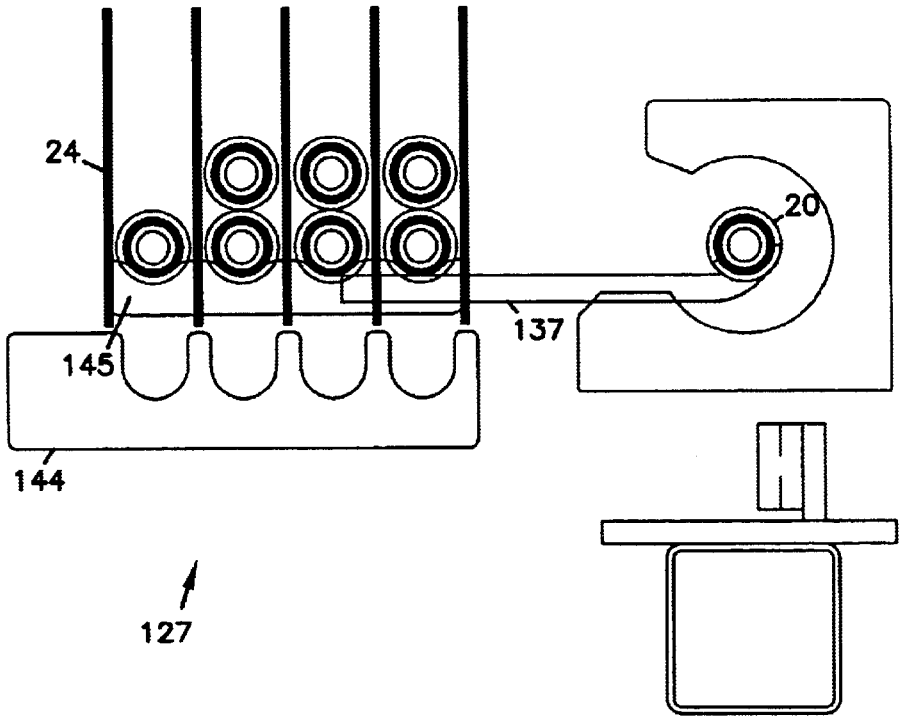
Figure 7D:
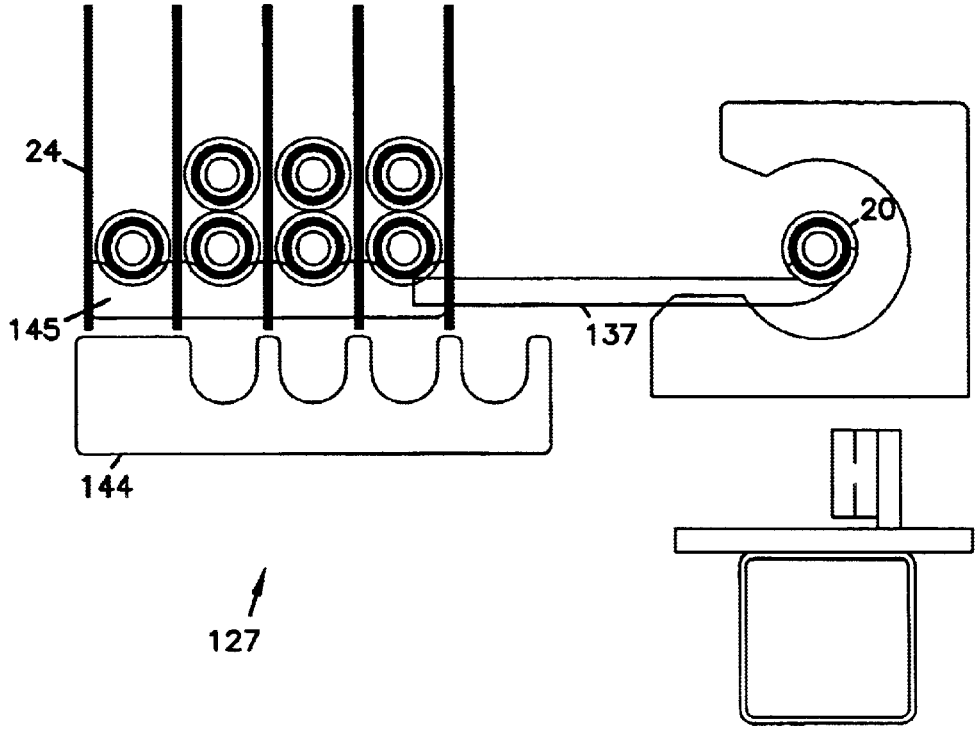
Figure 7E:
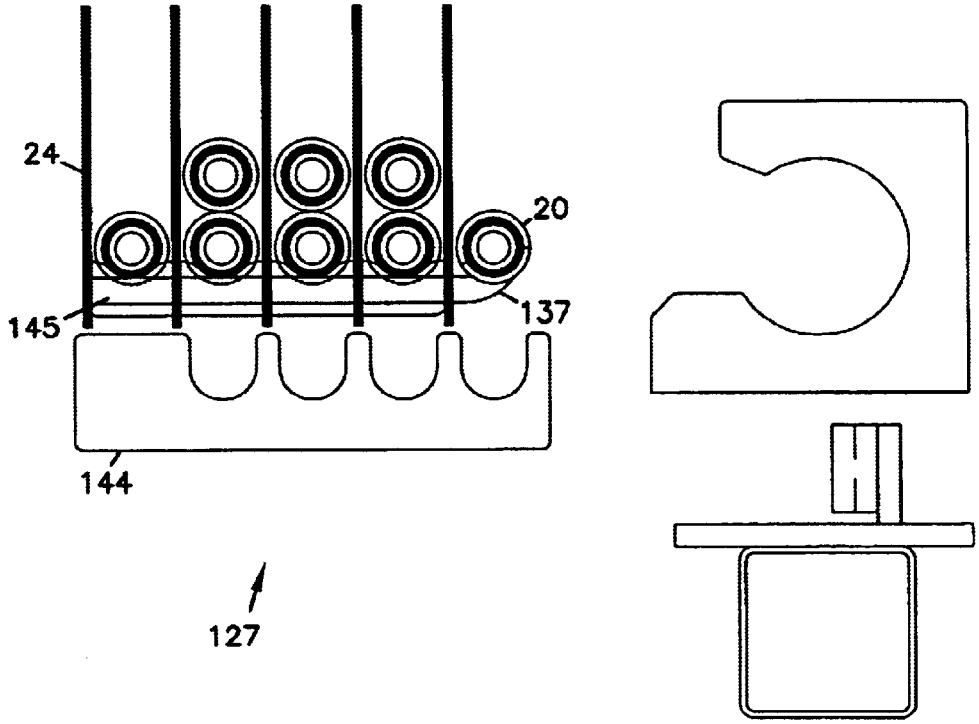
Figure 7F:
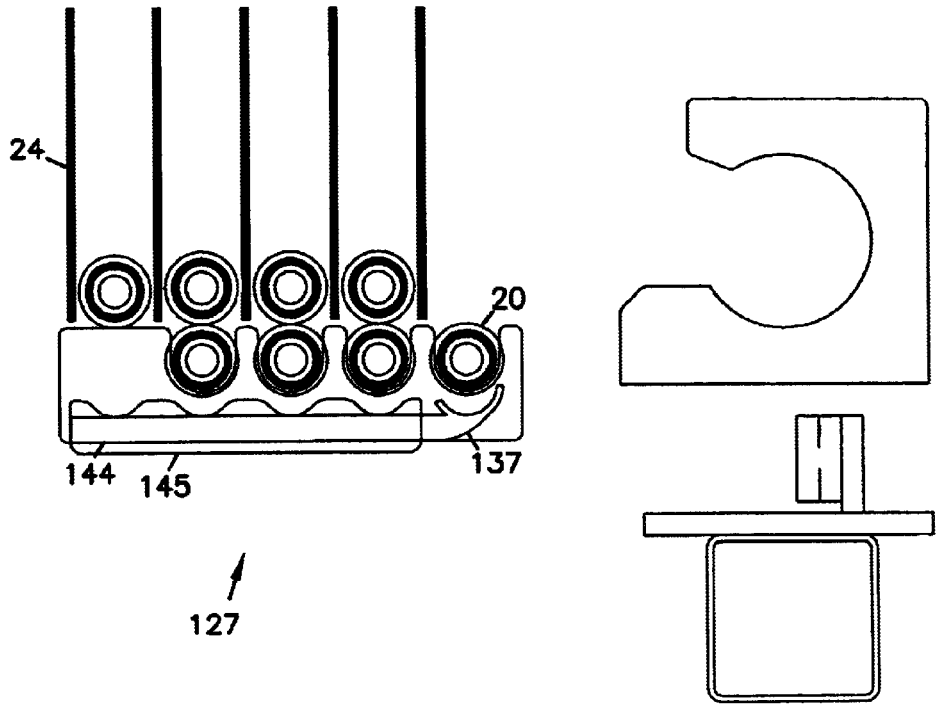
Figure 7G:
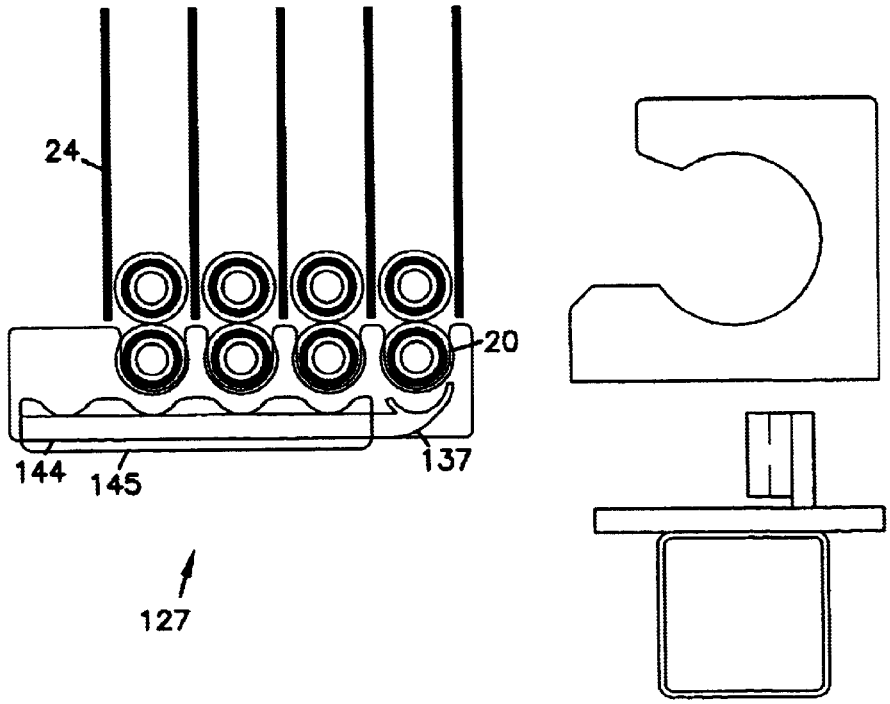
Figure 8:
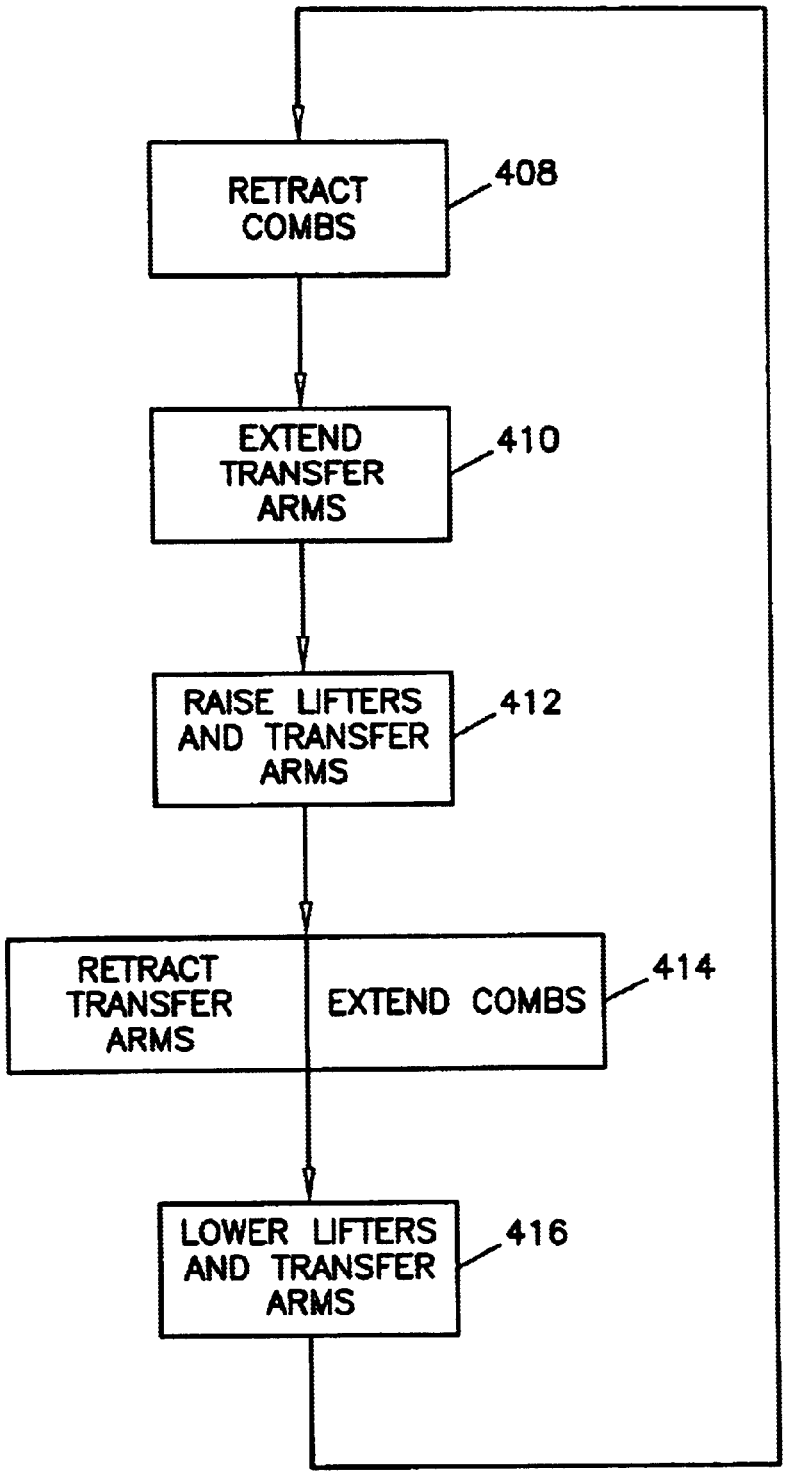
FIG. 8 is a logic diagram of steps used to load rods into the magazine as illustrated in FIGS. 7A–7G.

The control cycle for the rod transfer mechanism during pullback or backreaming is illustrated in FIG. 8. At step 408, the combs 144 are retracted while the pipe lifts 145 are in a lowered orientation (see FIG. 7A). At step 410 the transfer arms 137 are extended as shown at FIG. 7B. At step 412 the lifts 145 are raised with the transfer arms 137 as shown at FIG. 7C. At step 414 the transfer arms 137 are retracted and combs 144 extended as shown in FIGS. 7D and 7E. Preferably, the retraction of the arms 137 and the extension of the combs 144 occurs simultaneously. Finally, at step 416 the lifts 145 are lowered with the transfer arms 137 as shown at FIG. 7F. Thereafter, the control logic proceeds back to step 408 where the combs 144 are again retracted as shown in FIG. 7G. By repeating the above sequence, additional rods can be added to the rod box 24. Many other specific sequences are possible with this or other rod loader mechanisms. For example, in certain embodiments, the retraction of the combs 144 will always be simultaneous with the extension of the arms 137 and the retraction of the arms will always be simultaneous with the extension of the combs 144. In this embodiment, the mechanism will never be oriented as shown in FIGS. 7A and 7G.

Figure 9:
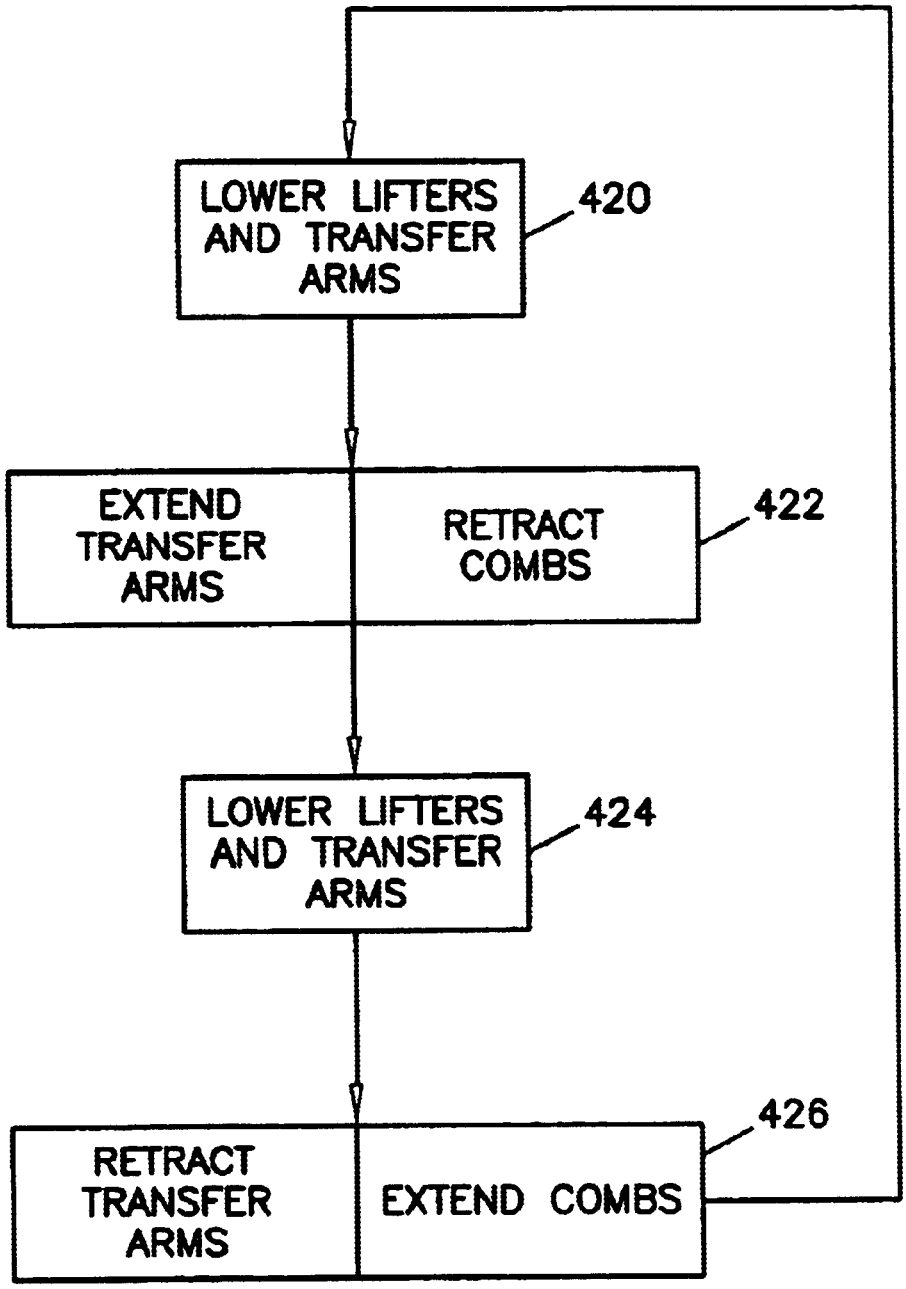
FIG. 9 is a logic diagram of steps used to unload rods from a magazine.
Figure 10A:
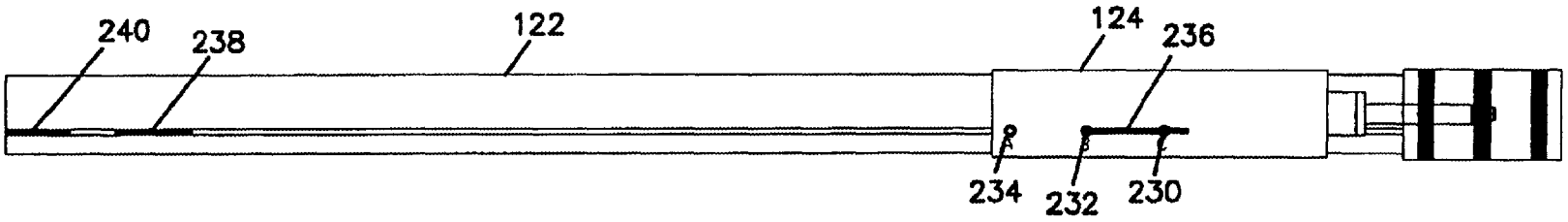
FIGS. 10A–10G are top views of a drive head position sensor arrangement in accordance with the principles of the present invention.
Figure 10B:
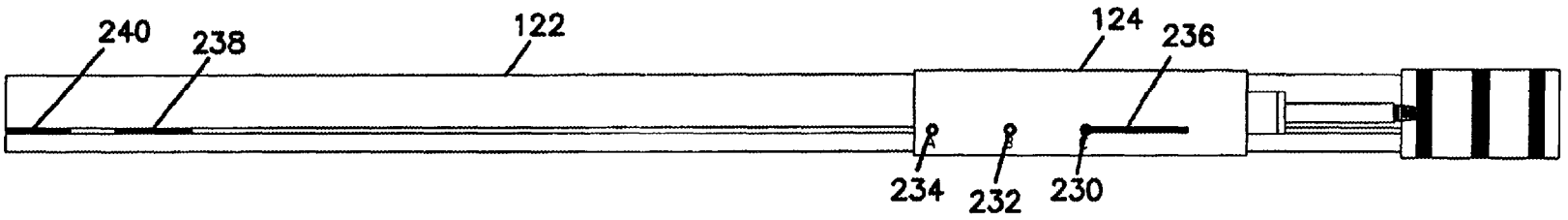
Figure 10C:
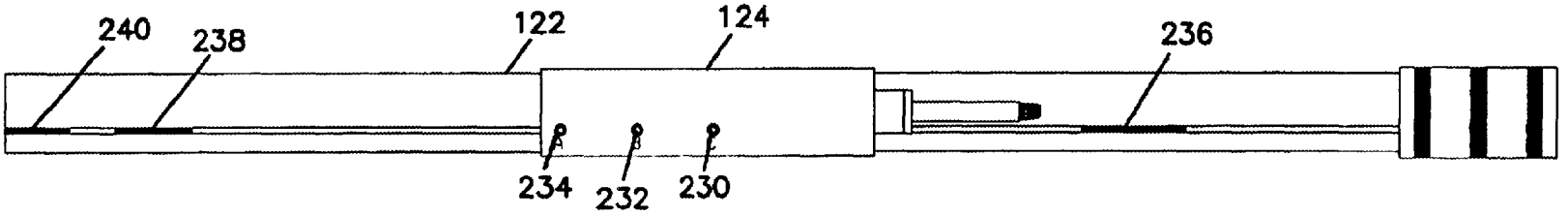
Figure 10D:
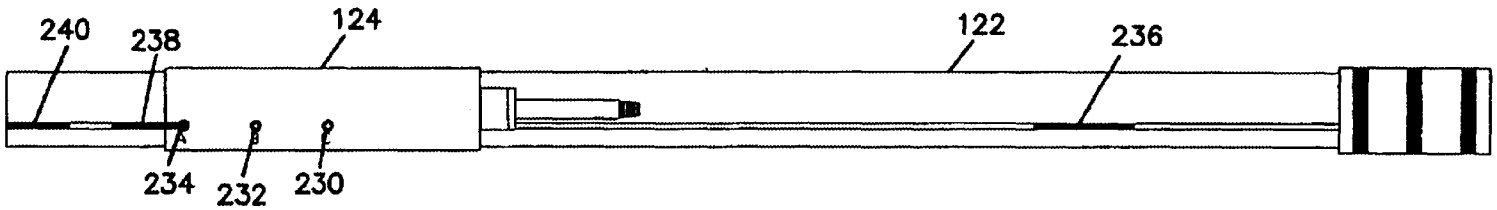
Figure 10E:
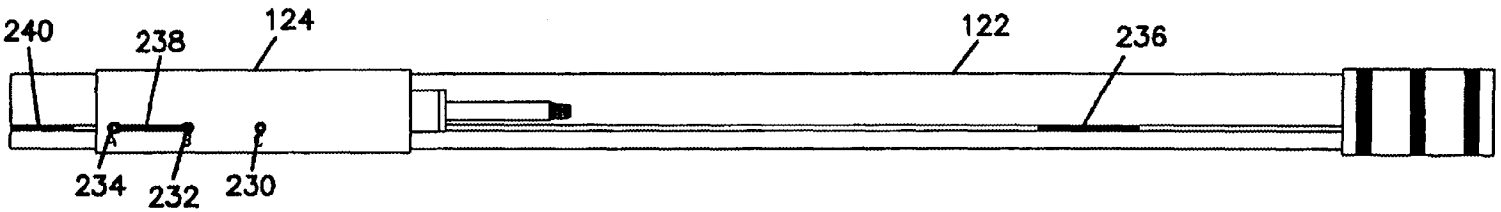
Figure 10F:
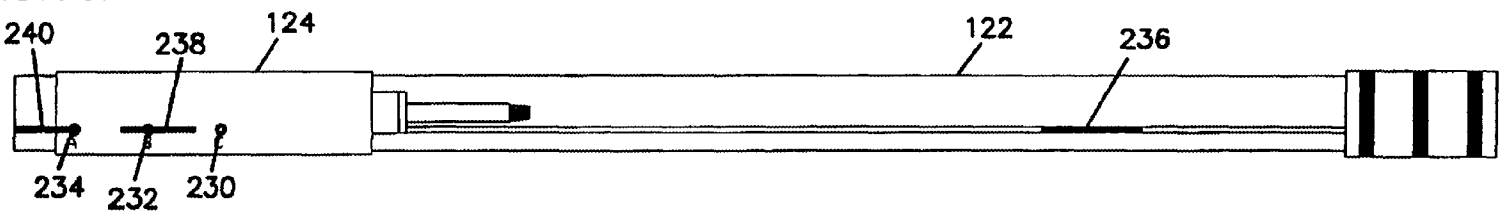
Figure 10G:
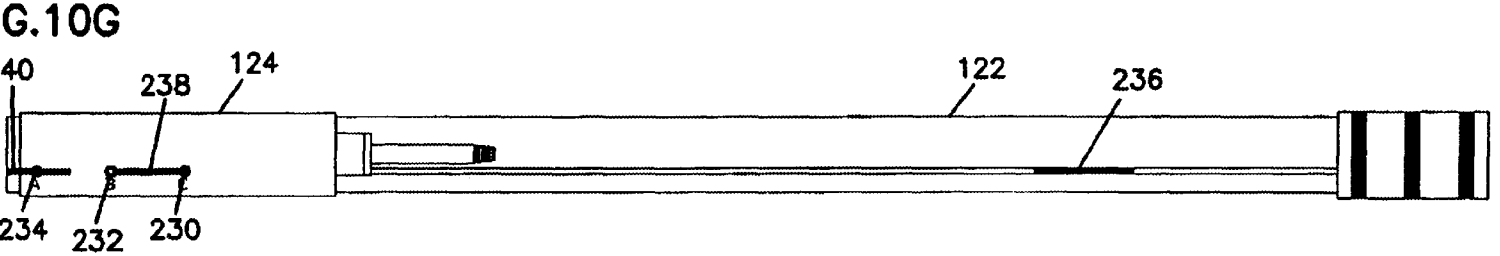

The control cycle for the rod transfer mechanism 127 during drilling is illustrated at FIG. 9. The sequence is initiated with the rod transfer mechanism in the position of FIG. 7F. At step 420, the lifts 145 are raised with the transfer arms 137 as shown at FIG. 7E. At step 422, the transfer arms 137 are extended and combs 144 simultaneously retracted to reach the position of FIG. 7C. At step 424 the lifts 145 are lowered with the transfer arms 137 as shown at FIG. 7B. At step 426, the transfer arms 137 are retracted and combs 144 simultaneously extended such that the mechanism returns to the position of FIG. 7F. It will be appreciated that when the mechanism returns to the position of FIG. 7F, the left-most column will be empty since the pipe previously occupying that column will have been transferred to the combs 144.

IV. Mechanism for Monitoring Longitudinal Location of Rotational Drive Assembly

In both the drilling cycle and the pull-back cycle, the operator coordinates the rotational and longitudinal drivers and the vices. In addition, the operator controls the rod transfer mechanism sequence, with many of the steps overlapping. During the sequence, when the transfer arms 144 are extended, there is the possibility to severely damage the machine by forcing the rotational drive assembly 124 to interfere with the transfer arms 144. There is a possibility of operator error, due to the overlapping sequences, which could result in this damage.

Due to this inherent potential interference with the rotational drive assembly 124, proper control of the transfer arms 137 is dependent on the position of the rotational drive assembly 124. FIGS. 10A–10G illustrate a preferred embodiment of providing inputs representing location of rotational drive assembly 124 along the track 122. In this embodiment 3 switches 230, 232, and 234 (e.g., proximity switches) are mounted on the rotational drive assembly 124 in a manner that they are moved along the track 122. These switches are in their normal state when they are not adjacent to any actuating surface. There are also 3 actuating surfaces 236, 238 and 240 (e.g., flags). In this embodiment the actuating surface 236 is wide enough to activate 2 switches at once, while the other two are only able to activate one switch. The spacing to the switches and location of the actuating surfaces are designed to provide inputs corresponding to the positions illustrated in FIGS. 10A–10G:

| FIG. | Description | Switch 230 | Switch 232 | Switch 234 |
|---|---|---|---|---|
| 10A | Forward Stop | 1 | 1 | 0 |
| 10B | Forward Slow | 1 | 0 | 0 |
| 10C | Normal | 0 | 0 | 0 |
| 10D | Reverse Slow | 0 | 0 | 1 |
| 10E | Position to break rod from drill string | 0 | 1 | 0 |
| 10F | Position to grip rod while breaking rod from rotational drive assembly 124 | 0 | 1 | 1 |
| 10G | Rear Stop | 1 | 0 | 1 |

With this arrangement, 7 conditions relating to positions of the rotational drive assembly 124 along the track 122 can be detected utilizing 3 switches. It is noted that surface 236 is Preferably longer than the distance between switches 232 and 230. In this embodiment, the drive assembly 124 reaches its upper travel limit before switch 234 reaches surface 236. Thus, in this embodiment, switch 234 is never actuated by surface 236. Similarly, the drive assembly 124 reaches its lower travel limit before switch 232 reaches surface 240. Thus, in this embodiment, switches 232 and 230 are never actuated by surface 240. Surface 238 is preferably shorter than distance between switches 234 and 232, and is also shorter than the distance between switches 232 and 230.

Many other techniques of determining position of the gearbox are possible; one alternative method of accurately positioning the gearbox includes use of a sensor that is capable of measuring movement of the gearbox, and constantly calculating the speed and position of the gearbox. In a configuration in which the gearbox is propelled along the track with a rack & pinon drive, it is possible to detect rotation of the pinion gear or movement along the rack gear, sensing every time that a gear tooth passes a sensor, as is known in the prior art.

By way of example, the system may be implemented to allow for full speed travel during the first 90% of the travel, for example, and then provide for deceleration during the final 10% of travel, and subsequently stopped after having moved a predefined distance as determined by counting the number of teeth. These percentages of travel may be varied as needed or required. For example, full speed travel may occur during the first 95% to 98% of the travel, and deceleration may occur during the final 5% to 2% of travel. This approach has the advantage of being tolerant of variations in engine speed, pump efficiency, mechanical friction, and other variables affecting the dynamic response of the overall system.

V. Overall Control System for First Embodiment

Figure 11:
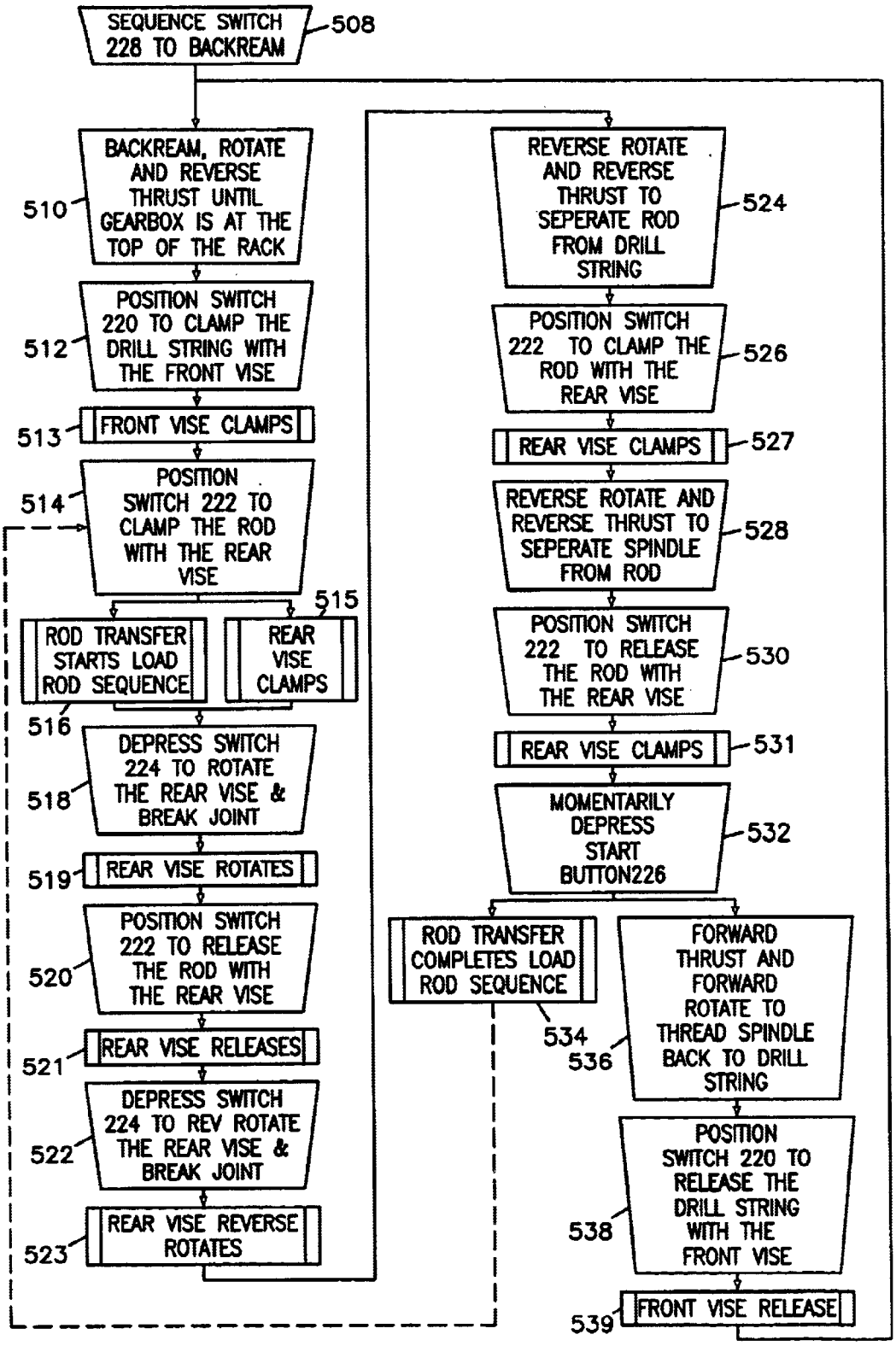
FIG. 11 is a flow chart of the process that an operator performs in backreaming and loading rods into the rod storage with a first embodiment of the present invention.
Figure 12:
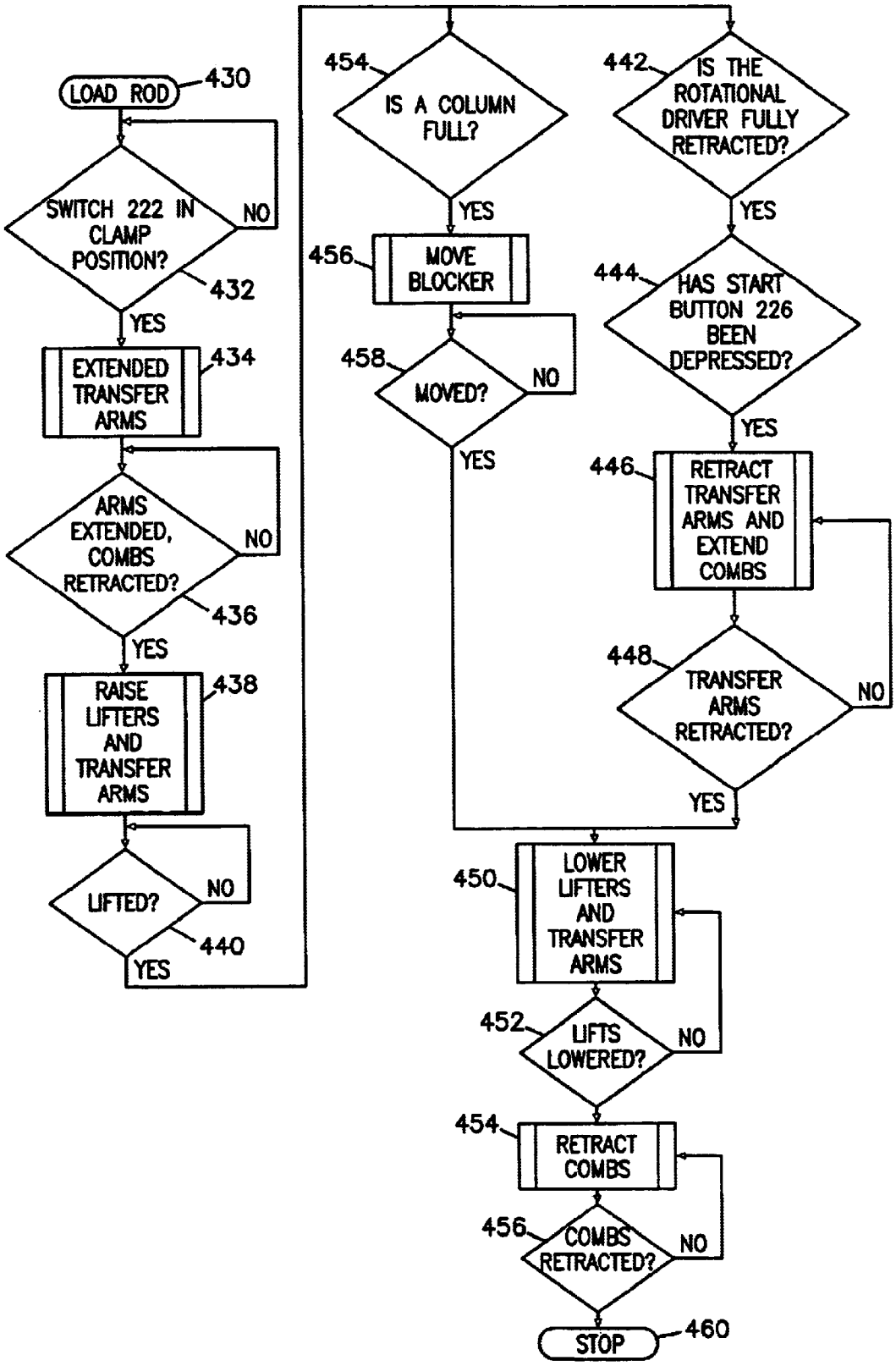
FIG. 12 is a logic flow chart of the control software for controlling the rod transfer mechanism in backreaming and loading rods into the rod storage with a first embodiment of the present invention.
Figure 13:
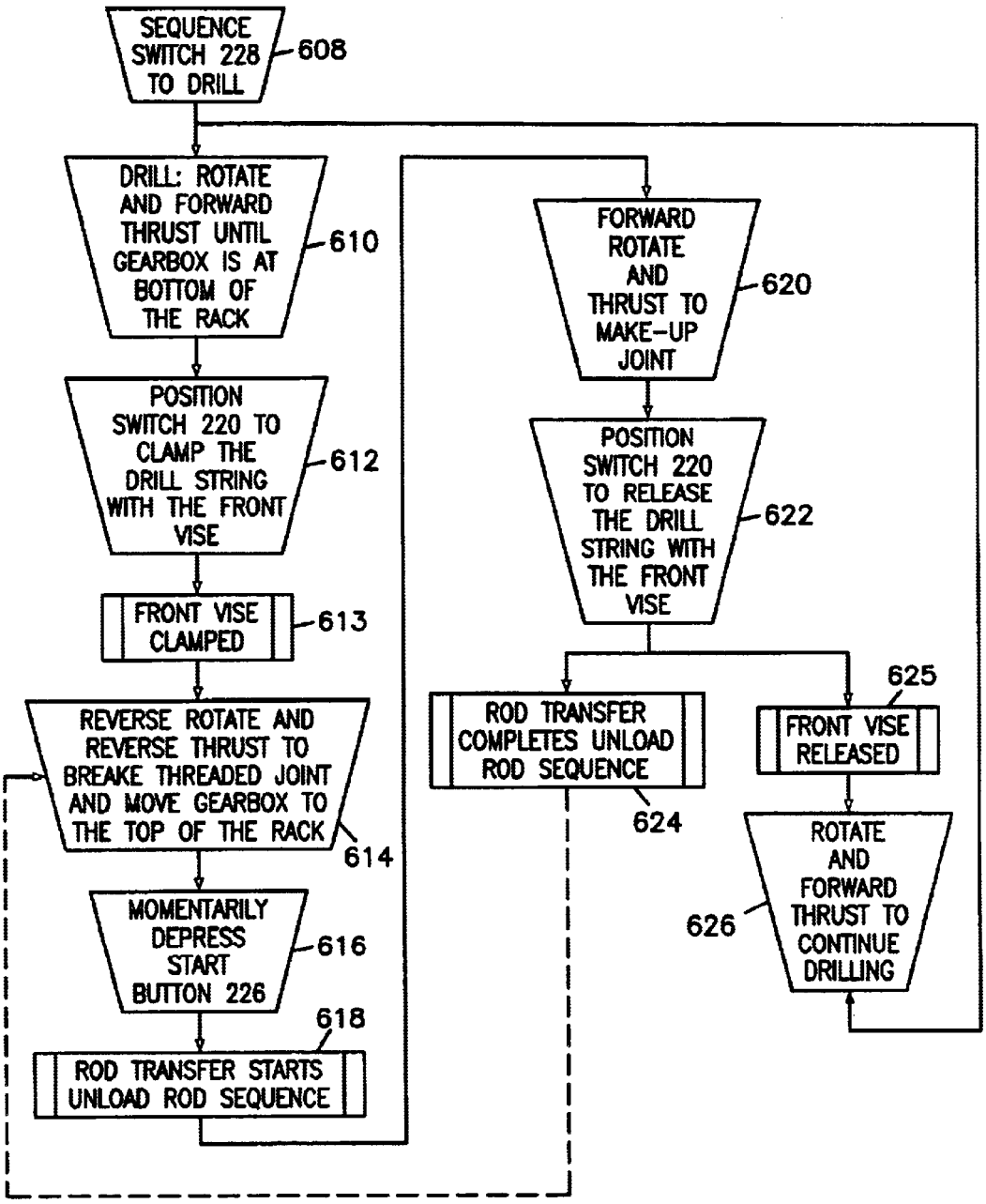
FIG. 13 is a flow chart of the process that an operator performs in drilling and unloading rod with a first embodiment of the present invention.
Figure 14:
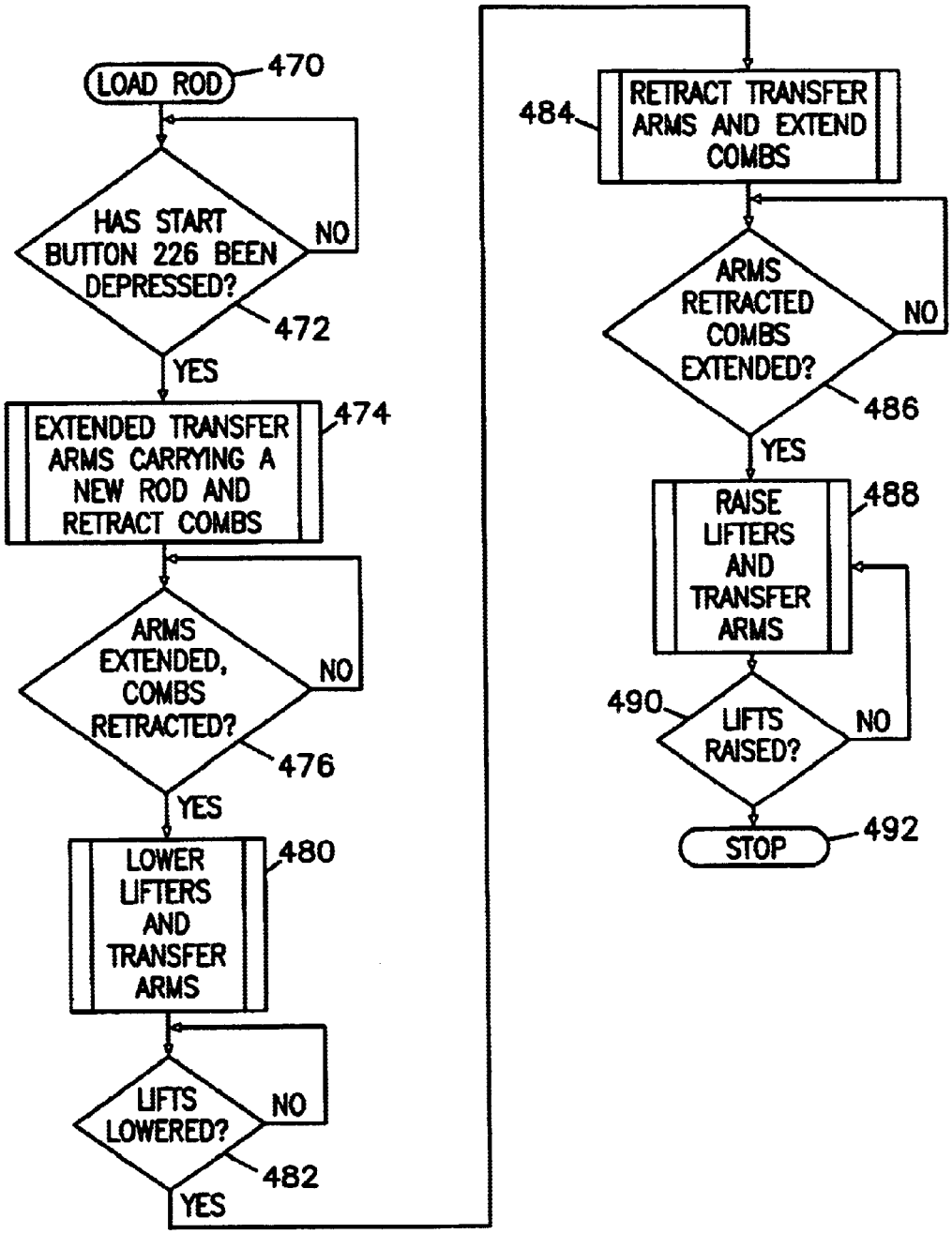
FIG. 14 is a logic flow chart of the control software for controlling the rod transfer mechanism in drilling and unloading rod with a first embodiment of the present invention.

The present invention involves an arrangement of operator inputs that provides an intuitive and reliable control that reduces the manual coordination of the separate mechanical systems utilized in the process of adding or removing rods. FIGS. 11 and 13 illustrate the operator's actions and resulting machine functions for a backreaming cycle and a drilling cycle respectively with a first embodiment. FIG. 12 illustrates the control logic for sequencing the rod transfer mechanism during backreaming while FIG. 14 illustrates the control logic during drilling for this first embodiment. This first embodiment utilizes switch inputs as illustrated in FIGS. 2–5, the first embodiment of the operator controls.

Looking to the flow charts, the shape of the boxes in the flowcharts indicates certain types of actions. For instance a trapezoid (e.g., box 510 at FIG. 11) indicates a manual action, something that the operator performs. A rectangle with boxed ends (e.g., box 516 at FIG. 11) indicates a predefined process, for instance what the machine does in response to a manual action. A diamond (e.g., box 432 at FIG. 12) indicates a decision point.

Looking at FIG. 11, the backreaming cycle can be defined as beginning when the operator positions the sequence switch 228 to the backream/pullback position, at step 508. The cycle then continues as the rotational drive assembly 124 is propelled to the top of the track 122 while rotating the drill string at step 510. At this point, it is furthest from the vices 150 and will have effectively pulled the drill string 22 back the length of one rod 20. At step 512, the operator positions switch 220 to clamp the drill string and at step 513 the machine activates the lower vice 152 to grip and hold the drill string 22. At step 514, the operator positions switch 222 to clamp the upper/rear vice 154 and at step 515 the machine activates the rear vice 154 to grip the rod. The operator's action at step 514 also initiates the load rod sequence of the rod transfer mechanism at step 516 causing the rod transfer mechanism 127 to move to the orientation of FIG. 7C. At step 518, operator positions switch 224 so as to forward rotate rear vice 154 and at step 519, the machine rotates the rear vice and rod 20 to break the threaded connection between the rod and the drill string. At step 520, the operator positions switch 222 to release the rear vice and at step 521 the machine releases the rear vice 154. At step 522, the operator positions switch 224 to reverse rotate the rear vice back to its home position, and at step 523 the machine reverse rotates the rear vice. At step 524, the operator controls the rotational and longitudinal drivers (e.g., by manipulating the left and right joysticks) to continue rotating the rod 20 while moving or allowing it to move longitudinally to completely unthread the connection between the rod 20 and the drill string 22.

To avoid damage to the threads, the action of unthreading the connection requires coordination of the rotational drive assembly 124 and the longitudinal driver. In this system, the longitudinal driver is controlled such that whenever the front vice is gripping the drill string, the maximum longitudinal force is limited such that the rotational drive assembly 124 will move, but the threads will not be damaged. This control technique is utilized each time that the threads are being engaged or disengaged. In practicing this technique, a thrust limiter of the type disclosed in U.S. Ser. No. 09/525,408, which is hereby incorporated by reference, can be used. The thrust can also be computer controlled.

At step 516, the transfer arms 137 of the rod transfer mechanism 127 were moved to the position of FIG. 7C. In this position, the transfer arms 137 are adapted for supporting the rod 20 as the rod is uncoupled from the drill string 22. Once the threaded connection between the rod and the drill string 22 is completely separated, the operator positions switch 222 to clamp rear vice at step 526 and at step 527 the machine clamps the rear vice so the rod 20 is again held. The rotational drive assembly 124 is then reverse rotated and moved or allowed to move longitudinally to completely separate the threaded connection between the rotational drive assembly 124 and the rod 20 at step 528. At this point, the rod 20 is completely supported by the transfer arms 137 and it is appropriate for the operator to visually check to insure that the rod is in good condition and that it is properly positioned on the rod transfer mechanism. The operator can then actuate switch 222 as indicated at step 530. Actuation of switch 222 causes the rear vice to release the rod as shown at step 531. Thereafter, the operator can depress the start 226 button at step 532 to initiate completion of the load rod sequence as indicated at step 534. To complete the load rod sequence, the transfer arms 137 are retracted thereby transferring the rod 20 towards the rod box 24. The rod is then lowered into the combs 144, the combs 144 are retracted, and the rod is then lifted into the magazine to be stored for future use.

Once the transfer arms are retracted, the operator can move the rotational drive assembly 124 down the track and thread to the drill string at step 536 while the machine is completing the sequence of the rod transfer mechanism. At step 538, the operator positions switch 220 and at step 539 the front vice releases the drill string and the cycle returns to step 510 where rotational drive assembly 124 can rotate and pull the drill string back another rod length.

In this process the operator has directly controlled 2 switches that effected operation of the rod transfer mechanism; at step 514 when switch 222 was activated to clamp the rod with the rear vice and simultaneously initiate the load rod cycle and at step 532 when the start button was depressed signifying that the conditions were proper, and initiating completion of the load rod cycle.

FIG. 12 illustrates the corresponding logic for the rod transfer mechanism. Starting at step 430, where the load process starts with the mechanism in the position as illustrated in FIG. 7A, the first step involves an operator input, in this embodiment when switch 222 is put into the clamp position, at step 432. This corresponds to step 514 on FIG. 11. Once this event happens, the transfer arms are extended at step 434. In this embodiment, limit switches have been utilized to confirm/ensure the proper position, so at step 436 this control system waits for verification of proper positioning. Once verified, the lifters and transfer arms are automatically raised at step 438. Confirmation is required at step 440. Once that action is competed, the rod transfer mechanism is in the position illustrated in FIG. 7C. The control system then confirms that the rotational driver 124 is fully retracted at step 442 and then waits for input from the operator at step 444. This comes by the operator depressing the start button 226 as in step 532 of FIG. 11. Once that switch has been depressed, the rod transfer mechanism is controlled to retract the transfer arms and extend the combs at step 446. Verification occurs at step 448.

Steps 454, 456 and 458 illustrate an additional process that is happening simultaneous with steps 442, 444, 446 and 448. These steps involve the automated positioning of a row blocker. Various embodiments of row blockers can be seen in applicant's pending U.S. patent application Ser. Nos. 09/602,415 and 09/602,036 herein incorporated by reference. This additional process is illustrative of the required synchronization of mechanical systems that this invention is capable of accomplishing.

Once confirmation that the transfer arms are retracted is received at step 448 the lifts and transfer arms are lowered at step 450. Confirmation of that action occurs at step 452. The combs are then retracted at step 454 and confirmed at step 456 bringing the sequence to the end of the cycle at step 460 with the rod transfer mechanism in the position as shown in FIG. 7G.

The drilling process is illustrated for the first embodiment in FIGS. 13 and 14. It can be viewed as beginning when the operator positions sequence switch 22 to the drilling position at step 608. The process then continues at step 610 of FIG. 13 with the operator performing the actual boring process of rotating and longitudinally propelling the drill string until the rotational drive assembly 124 is at the bottom of the track. At this point, the operator positions switch 220 and the front vice is applied to the drill string at steps 612 and 613. The operator then reverse rotates the drive check 123 with the rotational drive assembly 124 and reverses the longitudinal driver to break the joint between the drive chuck 123 and the drill string 22, and then moves the rotational drive assembly 124 to the top of the track at step 614. Once the rotational drive assembly 124 is positioned at the top of the track, the operator can observe that the next rod is loaded onto the rod transfer arms, as the mechanism is in the position as illustrated in FIG. 7E, and depress the start button 226 at step 616. The rod transfer mechanism then starts the unload rod sequence at step 618, transferring a rod by extending the transfer arms into the position illustrated in FIG. 7D. The operator then forward rotates and moves the rotational drive assembly 124 longitudinally down the track to thread the drive chuck 123 into the new rod 20 and the new rod 20 into the drill string 22 at step 620. Once the joints are properly made-up, the operator positions switch 220 to release the front vice at step 622. The front vice is released at step 625. In addition to releasing the front vice, the action of positioning switch 220 also signals the rod transfer mechanism to complete the unload rod sequence at step 624. The operator can then simultaneously rotate and propel the rotational drive assembly 124 along the track with the longitudinal driver to continue drilling at step 626.

In this process, the operator has directly controlled the same two switches as in the backreaming cycle; at step 616 the start button 226 was activated to initiate the unload rod cycle. At step 622 switch 220 was activated to release the front vice and initiate completion of the unload rod cycle.

FIG. 14 illustrates the corresponding logic for one cycle of the rod transfer mechanism. Starting at step 470 the process starts when the start button 226 is depressed at step 472. This step corresponds to step 616 of FIG. 13. The transfer arms extend automatically at step 474 with corresponding sensors confirming completion at step 476 indicating the new rod is in alignment with the drill string. As explained in reference to FIGS. 11 and 12, this embodiment utilizes switches to provide feedback about the position of the various mechanical elements, and the control system operates automatically in response to the proper confirmation; the proper feedback from the appropriate position switch.

The rod is supported in this position until at step 478 there is confirmation that the threaded joints have been torqued-up and the drilling process is set to begin, as signaled at step 478 when switch 220 is positioned to release the front vice. This step corresponds to step 622 of FIG. 13. Once that signal is received, the lifts and transfer arms 137 are lowered to the positioned of FIG. 9B at step 480. The lowering is confirmed at step 482. The transfer arms 137 are then retracted and the combs 144 extended at step 484 (see FIG. 7F) with confirmation at step 486. The lifters and transfer arms are raised at step 488 (see FIG. 7E) with confirmation at step 490, and the cycle concludes at step 492.

VI. Overall Control System for Second Embodiment

Figure 15:
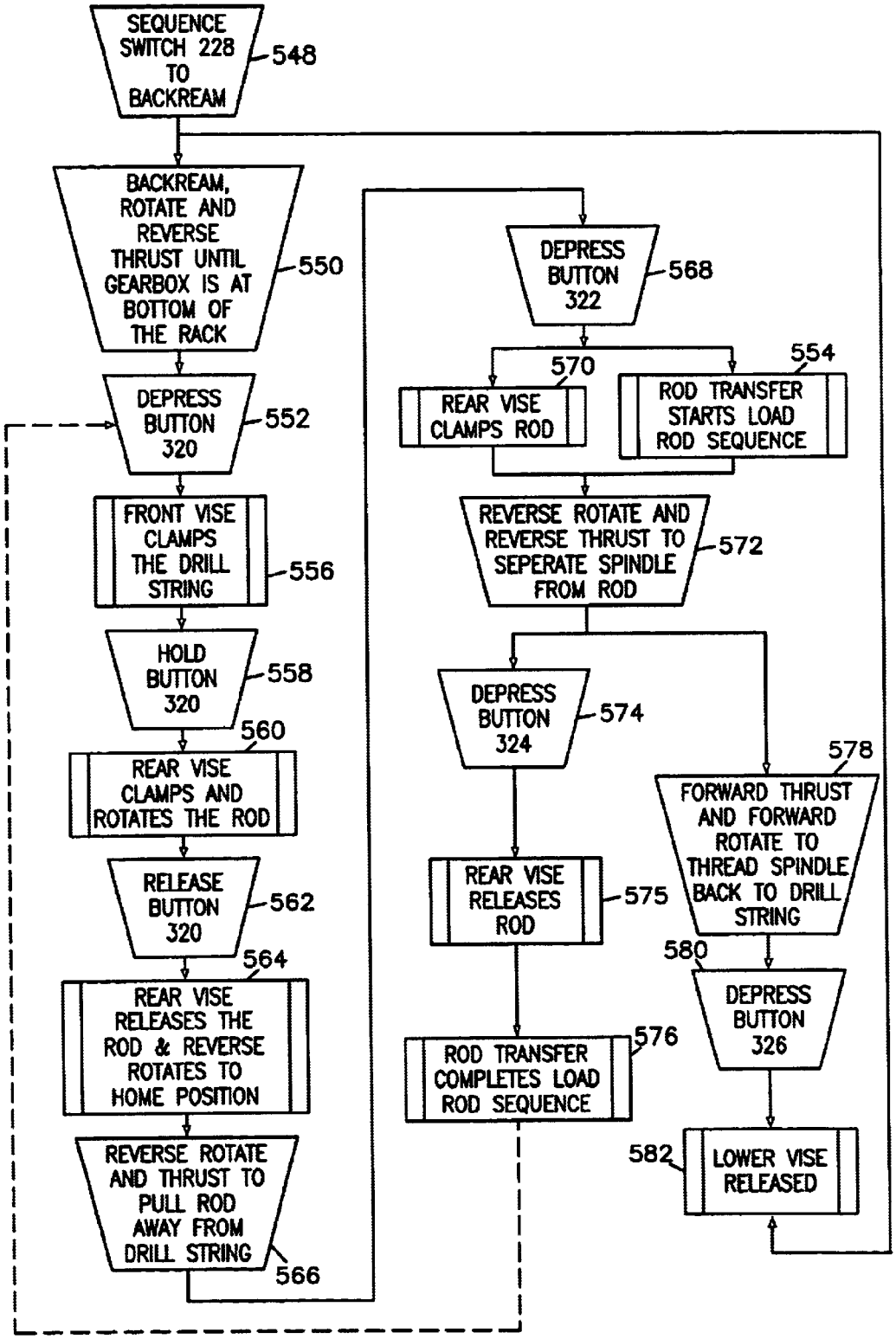
FIG. 15 is a flow chart of the process that an operator performs in backreaming and loading rods into the rod storage with a second embodiment of the present invention.
Figure 16:
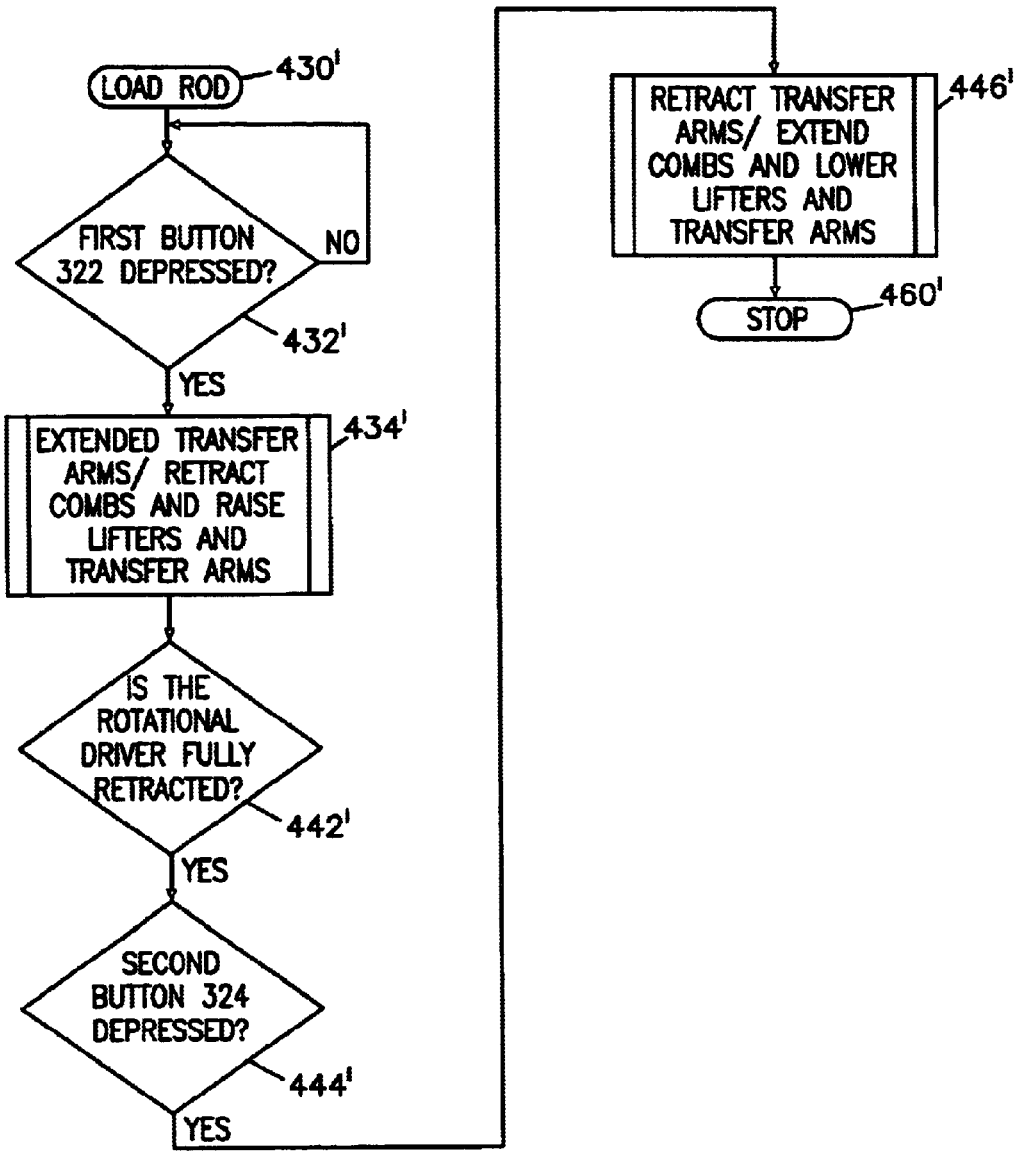
FIG. 16 is a logic flow chart of the control software for controlling the rod transfer mechanism in backreaming and loading rods into the rod storage with a second embodiment of the present invention.
Figure 17:
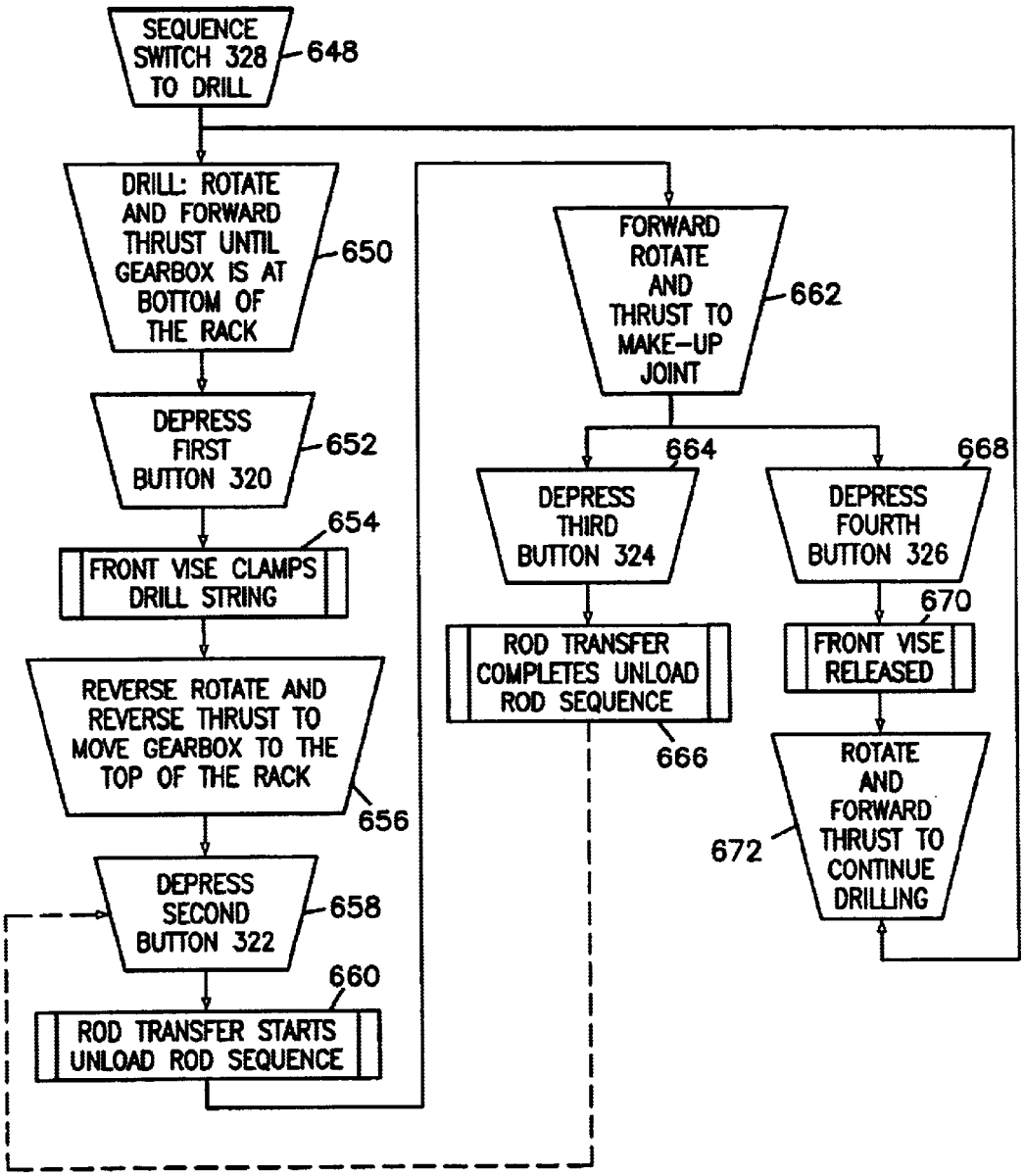
FIG. 17 is a flow chart of the process that an operator performs in drilling and moving rod out of the rod storage with a second embodiment of the present invention.
Figure 18:
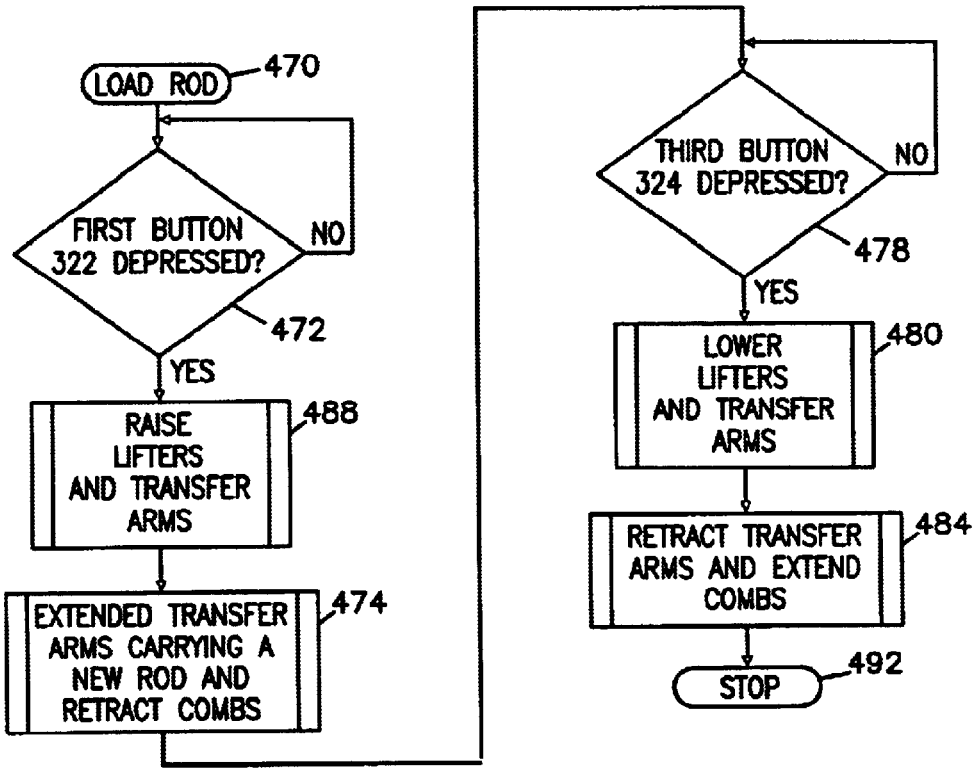
FIG. 18 is a logic flow chart of the control software for controlling the rod transfer mechanism in drilling and moving rod out of the rod storage with a second embodiment of the present invention.

FIGS. 15 and 17 illustrate the operator's actions and resulting machine functions for a backreaming cycle and a drilling cycle respectively with a second embodiment. FIG. 16 illustrates the control logic for sequencing the rod transfer mechanism during backreaming while FIG. 18 illustrates the control logic during drilling for this second embodiment. This second embodiment utilizes switch inputs as illustrated on the joystick 86' of FIG. 6.

Looking now at the backreaming cycle with the second embodiment illustrated in FIG. 15, the backreaming cycle will begin at step 548 when the operator has selected the backreaming/pullback with sequence switch 228 of the left hand control arrangement. The process then continues as the rotational drive assembly 124 is propelled to the top of the track 122 while rotating the drill string at step 550. At this point, it is furthest away from the vices 150 and will have effectively pulled the drill string 22 back the length of one rod 20. At this point, the operator depresses button 320 at step 552 and the front vice 152 grips and holds the drill string 22 at step 556. At step 558, the operator holds down button 320, which or may not have been released at step 552. Holding button 320 will cause the rear vice to grip and rotate the rod at step 560. The operator will visually confirm that rear vice clamp has rotated rod 20 and broken the joint between the rod 20 and drill string 22. The operator can release button 320 at step 562 which will result in the rear vice opening and reversing its previous rotation, back to its home position at step 564. If the joint between the rod and the drill string is not broken the operator can depress button 320 as in step 558 again to attempt to break the joint. If the joint is broken, the operator controls the rotational and longitudinal drivers at step 566, rotating the rod 20 while moving or allowing it to move longitudinally to completely unthread that connection. Once the threaded connection between the rod 20 and the drill string 20 is completely separated, the operator depresses button 322 at step 568 and the rear vice 154 again clamps the rod 20 at step 570. The operator's action at step 568 also initiates the load rod sequence of the rod transfer mechanism at step 554. Initiation of the rod load sequence causes the transfer arms 137 to be moved from the position of FIG. 7F to the position of FIG. 7C. In the position of FIG. 7C, the arms 137 are poised to support the rod 20. The rotational drive assembly 124 is then reverse rotated and moved or allowed to move longitudinally to completely separate the threaded connection between the rotational drive assembly 124 and the rod 20 at step 572. At this point the rod 20 is completely supported by the transfer arms 137 and it is appropriate for the operator to visually check to insure that the rod is in good condition and that it is properly positioned on the rod transfer mechanism. The operator can then depress the button 324 at step 574 to release the rear vice at step 575 and the transfer arms 137 withdraw at step 576 to position shown in FIG. 7E, transferring the rod 20 towards the rod box 24. The load rod sequence is completed at step 576 such that the rod 20 is moved to the magazine for storage.

The rotational drive assembly 124 can be simultaneously moved down the track and threaded to the drill string at step 578. At step 580 the operator depresses button 326 and at step 582 the front vice is released. The rotational drive assembly 124 can rotate and pull the drill string back another rod length and the cycle start over at step 550.

In this process the operator has directly controlled 2 switches that effected operation of the rod transfer mechanism. At step 568 button 322 was depressed to clamp the rod with the rear vice which simultaneously initiated the load rod cycle. At step 574 the button 324 was depressed, signifying that the conditions were proper, releasing the rear vice and initiating completion of the load rod cycle. Further, the rod break-out and transfer process is preferably accomplished by sequentially actuating the row of buttons (320–326) from left to right.

FIG. 16 illustrates the corresponding logic for the rod transfer mechanism. Starting at step 430' with the mechanism in the position as illustrated in FIG. 7F, the load process starts with a first step of an operator input, in this embodiment when button 322 is depressed, at step 432'. This corresponds to step 568 on FIG. 15. Once this event happens, the transfer arms 137 are extended and combs 144 retracted at step 434' (see FIG. 7B). In this embodiment the transfer arms and combs are preferably moved simultaneously such that when the transfer arms extend the combs retract and vice-a-versa. The hydraulic circuit includes pressure triggered sequence valves installed to coordinate the movement of the transfer arms/combs and the lift/transfer arms. At this point of the cycle this is coordinated such that the transfer arms and combs move first, then the lifters and transfer arms are raised. Once that action is competed the rod transfer mechanism stops in the position illustrated in FIG. 7C.

The switches detecting position of the rotational drive assembly 124 will then be monitored to confirm that the rotational drive assembly 124 is fully retracted at step 442' to insure that the drive chuck is not connected to the rod. Once that condition is met and the operator depresses button 324 at step 444', the rod transfer mechanism is controlled to retract the transfer arms 137 and extend the combs 144, into position illustrated in FIG. 7E, then lower the lifters and transfer arms at step 446' (see FIG. 7F). The pressure sequence valves as described earlier control the sequence of these steps after the operator has depressed button 324. The cycle stops at step 460' with the rod transfer mechanism as shown in FIG. 7F.

The drilling process is illustrated for the second embodiment in FIG. 17 and 18. The process that the operator performs can be viewed as beginning in FIG. 17 when the sequence switch 228 is positioned to the drilling process at step 648. It continues at step 650 with the operator performing the actual boring process of rotating and longitudinally propelling the drill string until the rotational drive assembly 124 is at the bottom of the track. At this point, the operator depresses button 320 and the front vice is applied to the drill string at steps 652 and 654. The operator then reverse rotates the drive chuck 123 with the rotational drive assembly 124 and reverses the longitudinal driver to break the joint between the drive chuck 123 and the drill string 22, then moves the rotational drive assembly 124 to the top of the track at step 656. The front vice continues to grip the drill string. Once the rotational drive assembly 124 is positioned at the top of the track, the operator can observe that the next rod is positioned to be transferred, as the rod transfer mechanism is in the position as shown in FIG. 7F. The operator then depresses the button 322 at step 658, which causes the rod transfer mechanism to start the unload rod sequence at step 660 by raising the lifters and extending the transfer arms carrying a new rod into alignment with the drill string as shown in FIG. 7C. The operator then forward rotates and moves the rotational drive assembly 124 longitudinally down the track to thread the drive chuck 123 into the new rod 20 and the new rod 20 into the drill string 22 at step 662. Once the joints are properly made-up the operator depresses button 324 at step 664, and the rod transfer mechanism completes the unload rod sequence at step 666. The operator can then depress button 326 at step 668 that causes the front vice to release the drill string at step 670. Once the front vice has released the drill string the operator can simultaneously rotate and propel the rotational drive assembly 124 along the track with the longitudinal driver to continue drilling at step 672.

In this process, the operator has directly controlled two switches, to directly affect operation of the rod transfer mechanism, as in the backreaming cycle. At step 658 depressing the button 322 initiates the unload rod sequence. At step 664 depressing the button 324 initiates completion of the unload rod sequence.

FIG. 18 illustrates the corresponding logic for this second embodiment for one drilling cycle of the rod transfer mechanism. Starting at step 470 the process proceeds when the button 322 is depressed at step 472. This step corresponds to step 652 of FIG. 17. The lifters and transfer arms are raised at step 488 and then the transfer arms extend at step 474 due to the pressure triggered sequence valve described earlier. As explained in reference to FIGS. 15 and 16, this embodiment utilizes pressure triggered sequence valves to coordinate the movement of two linear drive systems, coordinating the transfer arm extension/retraction and the extension/retraction of the combs with the raising/lowering of the lifters/transfer arms.

At the end of this specific cycle, the rod is supported by the transfer arms until at step 478 there is confirmation that the threaded joints have been torqued-up and the drilling process is set to begin, as signaled at step 478 when the operator depresses button 324. This step corresponds to step 666 of FIG. 17. As the operator depresses button 324 the lifts and transfer arms are lowered at step 480, a pressure triggered sequence valve is activated and the transfer arms retract and combs extend at step 484. The cycle concludes at step 492.

The operator has provided input at two points; step 472 with button 322 and at step 478 with button 324. These two embodiments utilize common concepts. Obviously many other modifications and variations of the present invention are possible in light of the above teachings. It is therefore to be understood that, within the scope of the appended claims, the invention may be practiced otherwise than as specifically described.

What is claimed is:

1. A drilling machine for drilling a string of drill rods into the ground when in a drilling mode and for removing the string of drill rods from the ground when in a pull-back mode, the drilling machine comprising:

a rod driver for pushing the drill rods into the ground and for pulling the drill rods from the ground;

lower and upper vice grips for making and braking joints between the drill rods;

a magazine for storing the drill rods;

a rod transfer member for moving rods from the magazine to the rod driver when the drilling machine is in the drilling mode, and for moving rods from the rod driver to the magazine when the drilling machine is in the pull-back mode, the rod transfer mechanism including a rod receiving location, the rod transfer mechanism being movable between an extended position where the rod receiving location is positioned adjacent to the rod driver and a retracted position where the rod receiving location is positioned adjacent the magazine;

a control station including first and second operator actuated switches;

the first switch that, when actuated while the drilling machine is in the pull-back mode, initiates a rod transfer sequence that brings the rod transfer member to the retracted position; and the second switch that, when actuated while the drilling machine is in the pull-back mode, simultaneously initiates: a) a vice grip sequence that causes the upper vice grip to move to a clamped position; and b) a rod transfer sequence that brings the rod transfer member to the extended position.

2. The drilling machine of claim 1, further comprising a joystick on which the first and second switches are mounted.

3. The drilling machine of claim 2, further comprising an operator chair, wherein the first and second switches are mounted on the joystick so as to face toward an operator seated in the chair.

4. The drilling machine of claim 2, further comprising an operator chair, wherein the first switch is mounted on the joystick so as to face away from the operator chair and the second switch is mounted on the joystick so as to face toward the operator chair.

5. The drilling machine of claim 2, further comprising third and fourth switches mounted on the joystick, wherein the first, second, third and fourth switches control all rod transfer member sequences and all vice grip sequences.

6. The drilling machine of claim 1, further comprising a third operator actuated switch that, when actuated while the drilling machine is in the drilling mode, simultaneously initiates: a) a vice grip sequence that causes the lower vice grip to move to an unclamped position; and b) a rod transfer sequence that brings the rod transfer member to the retracted position.

7. The drilling machine of claim 5, wherein the first, second, third and forth switches are arranged to face toward an operator and are arranged generally in a row, wherein the switches are depressed sequentially to break a joint and move a rod from the rod driver to the magazine during pull-back operations, and wherein the switches are depressed sequentially to move a rod from the magazine to the rod driver and to make a joint during drilling operations.

8. The drilling machine of claim 1, wherein the rod driver includes a rotational drive head mounted on a track, and wherein the drilling machine further comprises a sensing arrangement for detecting a position of the rotational drive head along a length of the track.

9. The drilling machine of claim 8, wherein the sensing arrangement includes 3 proximity sensors and 3 flags configured for detecting when the rotational drive head is positioned adjacent at least 7 different positions along the length of the track.

10. A method for operating a drilling machine including a rod grip and a longitudinal driver, the method comprising:

determining whether the rod grip is clamped or unclamped;

adjusting the maximum available thrust that can be provided by the longitudinal driver depending upon whether the rod grip is clamped or unclamped; and reducing the maximum available thrust to a value that prevents thread damage when the rod grip is clamped.

11. The method of claim 10, further comprising increasing the maximum available thrust when the rod grip is unclamped.

* * * * *